US011634892B2

(12) United States Patent
Gururaj et al.

(10) Patent No.: US 11,634,892 B2
(45) Date of Patent: Apr. 25, 2023

(54) EXCAVATING TOOTH ASSEMBLY WITH RELEASABLE LOCK PIN ASSEMBLY

(71) Applicant: HENSLEY INDUSTRIES, INC., Dallas, TX (US)

(72) Inventors: Karthik Halike Gururaj, Irving, TX (US); Sean M. Pitts, Mesquite, TX (US)

(73) Assignee: Hensley Industries, Inc., Dallas, TX (US)

( * ) Notice: Subject to any disclaimer, the term of this patent is extended or adjusted under 35 U.S.C. 154(b) by 295 days.

(21) Appl. No.: 17/095,526

(22) Filed: Nov. 11, 2020

(65) Prior Publication Data

US 2021/0156123 A1 May 27, 2021

Related U.S. Application Data

(60) Provisional application No. 62/941,485, filed on Nov. 27, 2019.

(51) Int. Cl.
*E02F 9/28* (2006.01)

(52) U.S. Cl.
CPC ..... *E02F 9/2833* (2013.01)

(58) Field of Classification Search
CPC ..... E02F 9/2833
USPC ..... 37/456
See application file for complete search history.

(56) References Cited

U.S. PATENT DOCUMENTS 1,917,431 A 12/1928 O'fallon
3,371,437 A 3/1968 Wilson et al.
3,453,756 A 7/1969 Schroeder
4,133,121 A 1/1979 Hemphill
4,335,532 A 6/1982 Hahn et al.
4,577,423 A 3/1986 Hahn
(Continued)

FOREIGN PATENT DOCUMENTS

CA 2760931 A1 * 6/2013 ..... E21B 23/02
JP 2016530420 A 9/2016
(Continued)

OTHER PUBLICATIONS

International Searching Authority, International Search Report and the Written Opinion of the International Searching Authority, PCT/US2020/062030 filed Nov. 24, 2020, Korean Intellectual Property Office, Republic of Korea, 12 pages.

*Primary Examiner* — Gary S Hartmann
(74) *Attorney, Agent, or Firm* — Haynes and Boone, LLP

(57) ABSTRACT

A lock pin assembly including a main body, a pin assembly, and a lock assembly. The main body includes a first bore extending longitudinally inwardly from a main body outer face and a second bore extending radially inwardly. The pin assembly is threadably disposable in the first bore to an inserted position and includes a pin body having a pin body outer face and a pin body inner face. The pin assembly also includes a rotatable shaft extending longitudinally through the pin body, wherein the rotatable shaft is rotatable between a locked position and an unlocked position, and a cam rotationally coupled to the rotatable shaft. The lock assembly is disposed in the second bore and is biased radially inwardly to inhibit removal of the pin assembly from the main body when the pin assembly is at the inserted position and the rotatable shaft is in the locked position.

26 Claims, 14 Drawing Sheets

(56) References Cited

U.S. PATENT DOCUMENTS

| | | | |
|---|---|---|---|
| 4,823,487 | A | 4/1989 | Robinson |
| 4,932,145 | A | 6/1990 | Reeves, Jr. |
| 5,063,696 | A | 2/1991 | Smith |
| 5,233,770 | A | 8/1993 | Robinson |
| 5,337,495 | A | 8/1994 | Pippins |
| 5,361,520 | A | 11/1994 | Robinson |
| 5,394,629 | A | 3/1995 | Ruvang |
| 5,491,915 | A | 2/1996 | Robinson |
| 5,653,048 | A | 8/1997 | Jones et al. |
| 6,108,950 | A | 8/2000 | Ruvang et al. |
| 6,393,739 | B1 | 5/2002 | Shamblin et al. |
| 6,439,796 | B1 | 8/2002 | Ruvang et al. |
| 6,467,203 | B2 | 10/2002 | Pippins |
| 6,574,892 | B2 | 6/2003 | Creighton |
| 6,708,431 | B2 | 3/2004 | Robinson et al. |
| 6,729,052 | B2 | 5/2004 | Ollinger et al. |
| 6,735,890 | B2 | 5/2004 | Carpenter et al. |
| 6,757,995 | B2 | 7/2004 | Pippins |
| 6,799,386 | B2 | 10/2004 | Robinson et al. |
| 6,826,855 | B2 | 12/2004 | Ruvang |
| 6,871,426 | B2 | 3/2005 | Keech |
| 6,959,506 | B2 | 11/2005 | Adamic et al. |
| 6,976,325 | B2 | 12/2005 | Robinson et al. |
| 6,986,216 | B2 | 1/2006 | Emrich |
| 7,032,334 | B2 | 4/2006 | Pippins |
| 7,069,676 | B2 | 7/2006 | Robinson et al. |
| 7,086,185 | B2 | 8/2006 | Pasqualini et al. |
| 7,121,023 | B2 | 10/2006 | Robinson et al. |
| 7,162,818 | B2 | 1/2007 | Ruvang et al. |
| 7,165,347 | B2 | 1/2007 | Dllinger et al. |
| 7,178,274 | B2 | 2/2007 | Emrich |
| 7,536,811 | B2 | 5/2009 | McClanahan |
| 7,603,799 | B2 | 10/2009 | Campomanes |
| 7,640,684 | B2 | 1/2010 | Adamic et al. |
| 7,681,341 | B2 | 3/2010 | Ruvang |
| 7,730,651 | B2 | 6/2010 | Carpenter |
| 7,788,830 | B2 | 9/2010 | Woerman et al. |
| 7,793,444 | B2 | 9/2010 | Jones |
| RE41,855 | E | 10/2010 | Ruvang et al. |
| 7,882,649 | B2 | 2/2011 | Carpenter et al. |
| 8,024,874 | B2 | 9/2011 | McClanahan et al. |
| 8,074,383 | B2 | 12/2011 | McClanahan |
| 8,122,621 | B2 | 2/2012 | Carpenter |
| 8,127,475 | B2 | 3/2012 | Harder et al. |
| 8,127,476 | B2 | 3/2012 | Bierwith |
| RE43,693 | E | 10/2012 | Emrich |
| 8,356,432 | B2 | 1/2013 | Carpenter |
| 8,387,290 | B2 | 3/2013 | Campomanes et al. |
| 8,393,097 | B2 | 3/2013 | Harder et al. |
| 8,578,637 | B2 | 11/2013 | Ollinger et al. |
| 8,689,472 | B2 | 4/2014 | Carpenter et al. |
| 8,720,087 | B2 | 5/2014 | Briscoe et al. |
| 8,898,937 | B2 | 12/2014 | Campomanes |
| 8,904,677 | B2 | 12/2014 | Cui |
| 8,931,190 | B2 | 1/2015 | Knight |
| 8,938,895 | B2 | 1/2015 | Pippins |
| 8,978,277 | B2 | 3/2015 | Knight |
| 9,222,243 | B2 | 12/2015 | Cheyne et al. |
| 9,249,558 | B2 | 2/2016 | Bierwith |
| 9,441,352 | B2 | 9/2016 | Bilal |
| 9,476,184 | B2 | 10/2016 | Wallis et al. |
| 9,540,795 | B2 | 1/2017 | Freund et al. |
| 9,562,347 | B2 | 2/2017 | Clendenning et al. |
| 9,650,764 | B2 | 5/2017 | Carpenter et al. |
| 9,702,122 | B2 | 7/2017 | Hurley et al. |
| 9,809,959 | B2 | 11/2017 | Graham et al. |
| 9,874,002 | B2 | 1/2018 | Lombardo et al. |
| 9,938,696 | B2 | 4/2018 | Quarfordt |
| 9,957,696 | B2 | 5/2018 | Kunz et al. |
| 9,963,853 | B2 | 5/2018 | Ollinger et al. |
| 10,030,368 | B2 * | 7/2018 | Vegunta ..... E02F 9/2825 |
| 10,041,231 | B2 | 8/2018 | Knight et al. |
| 11,136,746 | B2 * | 10/2021 | Vegunta ..... E02F 9/2841 |
| 11,492,784 | B2 * | 11/2022 | Bilal ..... E02F 9/2858 |
| 2003/0061744 | A1 | 4/2003 | Leslie et al. |
| 2003/0070330 | A1 | 4/2003 | Olds et al. |
| 2003/0101627 | A1 | 6/2003 | Robinson et al. |
| 2004/0016153 | A1 * | 1/2004 | Pippins ..... E02F 9/2841 37/456 |
| 2004/0107608 | A1 | 6/2004 | Meyers et al. |
| 2004/0139632 | A1 | 7/2004 | Robinson et al. |
| 2010/0162594 | A1 | 7/2010 | Bierwith |
| 2010/0236108 | A1 | 9/2010 | Ruvang |
| 2011/0072693 | A1 | 3/2011 | Knight |
| 2011/0258891 | A1 | 10/2011 | Ruvang |
| 2012/0051836 | A1 | 3/2012 | Jakubisin |
| 2012/0260539 | A1 | 10/2012 | Guimaraes et al. |
| 2012/0304506 | A1 | 12/2012 | Guimaraes et al. |
| 2013/0000162 | A1 | 1/2013 | Renski |
| 2015/0113839 | A1 | 4/2015 | Bilal |
| 2015/0368884 | A1 | 12/2015 | Cheyne et al. |
| 2016/0083935 | A1 | 3/2016 | Edmonds |
| 2016/0130789 | A1 | 5/2016 | Tanaka et al. |
| 2016/0237658 | A1 | 8/2016 | Ruvang |
| 2017/0226718 | A1 | 8/2017 | Snyder |
| 2017/0328035 | A1 | 11/2017 | Bilal et al. |
| 2017/0342688 | A1 | 11/2017 | Ruvang |
| 2018/0044894 | A1 | 2/2018 | Tuto et al. |

FOREIGN PATENT DOCUMENTS

| | | | |
|---|---|---|---|
| KR | 101618022 | B1 | 4/2007 |
| WO | 2012024731 | A1 | 3/2012 |

* cited by examiner

EXCAVATING TOOTH ASSEMBLY WITH RELEASABLE LOCK PIN ASSEMBLY

PRIORITY

This disclosure claims priority to and the benefit of the filing date of U.S. Provisional Patent Application 62/941,485, filed Nov. 27, 2019, titled Excavating Tooth Assembly with Releasable Lock Pin Assembly, incorporated herein by reference in its entirety.

TECHNICAL FIELD

This disclosure is generally directed to an excavating tooth assembly including a lock pin assembly that secures components of the excavating tooth assembly. More particularly, this disclosure is directed to an excavating tooth assembly secured by a releasable lock pin assembly having an improved locking structure with rotating pin assemblies including rotation prevention features to inhibit rotation of the rotating pin assemblies to prevent inadvertent unlocking of the lock pin assembly.

BACKGROUND

Material displacement apparatuses, such as excavating buckets found on construction, mining, and other earth moving equipment, often include replaceable wear portions such as earth engaging teeth. These are often removably carried by larger base structures, such as excavating buckets, and come into abrasive, wearing contact with the earth or other material being displaced. For example, excavating tooth assemblies provided on digging equipment, such as excavating buckets and the like, typically comprise a relatively massive adapter portion which is suitably anchored to the forward bucket lip. The adapter portion typically includes a reduced cross-section, forwardly projecting nose. A replaceable tooth point typically includes an opening that releasably receives the adapter nose. To retain the tooth point on the adapter nose, generally aligned transverse openings are formed on both the tooth point and the adapter nose, and a suitable connector structure is driven into and forcibly retained within the aligned openings to releasably anchor the replaceable tooth point on its associated adapter nose.

There are a number of different types of conventional connector structures. One type of connector structure typically has to be forcibly driven into the aligned tooth point and adapter nose openings using, for example, a sledge hammer Subsequently, the inserted connector structure has to be forcibly pounded out of the tooth point and adapter nose openings to permit the worn tooth point to be removed from the adapter nose and replaced. This conventional need to pound in and later pound out the connector structure can easily give rise to a safety hazard for the installing and removing personnel.

Various alternatives to pound-in connector structures have been previously proposed to releasably retain a replaceable tooth point on an adapter nose. While these alternative connector structures desirably eliminate the need to pound a connector structure into and out of an adapter nose, they typically present various other types of problems, limitations, and disadvantages including, but not limited to, complexity of construction and use, undesirably high cost, and the necessity of removing the connector structure prior to removal or installation of the replaceable tooth point.

Some types of connector structures include a locking mechanism. However, the continuous vibration, high impact, and cyclic loading of the tooth point can result in inadvertent rotation of components within the locking mechanism, leading to unlocking of the connector structure. This may cause excess wear on the connector structure and tooth point interface and may affect the useful life of both the connector structure and the tooth point.

A need accordingly exists for an improved connector structure.

SUMMARY

According to one exemplary aspect, the present disclosure is directed to a lock pin assembly. The lock pin assembly may include a main body including: a first bore extending longitudinally inwardly from a main body outer face; a second bore extending radially inwardly to an intersection with the first bore; and a pin assembly threadably disposable in the first bore to an inserted position, the pin assembly including: a pin body having a pin body outer face and a pin body inner face; a rotatable shaft extending longitudinally from the pin body outer face to the pin body inner face, wherein the rotatable shaft is rotatable between a locked position and an unlocked position; a cam rotationally coupled to the rotatable shaft adjacent the pin body inner face; and a lock assembly disposed in the second bore, wherein the lock assembly is radially displaceable in the second bore and radially biased to inhibit removal of the pin assembly from the main body when the pin assembly is at the inserted position and the rotatable shaft is at the locked position.

In some implementations, the pin body extends beyond the main body by a first longitudinal distance when the pin assembly is in the inserted position. The lock assembly may be biased radially inwardly against at least one of the cam and the pin body such that a distal face of the lock assembly is positioned against at least one of a cam outer profile and a pin body outer profile. In some implementations, the lock assembly includes: a base plate threadably received by the second bore; a follower; and a resilient member, wherein the resilient member extends between the base plate and the follower, and wherein the follower is biased radially inwardly against the cam by the resilient member.

In some implementations, the first bore extends longitudinally along a longitudinal axis of the main body, and wherein the second bore extends transverse to the longitudinal axis. The pin body may include a lock assembly recess shaped and sized complementary to at least a portion of the lock assembly such that the lock assembly recess receives at least a portion of the lock assembly (e.g., the follower) when the pin assembly is in the inserted position and the rotatable shaft is in the locked position. The pin body may include: a trailing portion configured to engage an implement (e.g., a tooth point, a wear member, an intermediate adapter, etc.); a leading portion configured to interface with the lock assembly; and a central portion extending between the trailing portion and the leading portion and including a plurality of pin assembly threads complementary to a plurality of main body threads extending along an inner surface of the first bore. In some implementations, the leading portion and/or the central portion may be tapered inward toward a leading end of the pin body.

In some implementations, the lock pin assembly further includes a limit pin extending from a cam inner face, wherein the pin body inner face includes a limit pin race, wherein the limit pin race is configured to receive the limit pin, and wherein the limit pin race is sized and positioned to constrain rotation of the cam to rotation between the locked position and the unlocked position. The limit pin may be configured to translate rotational energy from rotatable shaft to the pin body. The lock pin assembly may include a limit pin extending from the pin body inner face, wherein the cam includes a limit pin race, wherein the limit pin race is configured to receive the limit pin, and wherein the limit pin race is sized and positioned to constrain rotation of the cam to rotation between the locked position and the unlocked position.

In some implementations, the lock pin assembly further includes a second pin assembly and a second lock assembly, wherein the main body includes a third bore extending longitudinally inwardly from an outer face of the main body opposite the first bore, wherein the main body includes a fourth bore extending transverse to the third bore radially inwardly to an intersection with the third bore, wherein the third bore is configured to threadably receive the second pin assembly, and wherein the fourth bore is configured to receive the second lock assembly.

According to another exemplary aspect, the present disclosure is directed to a lock pin assembly for securing a wear member including an opening to a support structure having a passage alignable with the opening. The lock pin assembly may include: a main body including: a first bore extending longitudinally inwardly from a main body outer face; a second bore extending radially inwardly to an intersection with the first bore; and a pin assembly threadably disposable in the first bore in an inserted position, the pin assembly including: a pin body having a pin body outer face and a pin body inner face; a rotatable shaft extending longitudinally through the pin body from the pin body outer face to the pin body inner face, wherein the rotatable shaft is rotatable between a locked position and an unlocked position; a cam rotationally coupled to the rotatable shaft adjacent the pin body inner face; and a lock assembly disposed in the second bore, wherein the lock assembly is radially displaceable in the second bore and biased radially inwardly to inhibit removal of the pin assembly from the main body when the pin assembly is at the inserted position and the rotatable shaft is at the locked position.

In some implementations, the pin body extends beyond the main body by a first longitudinal distance to inhibit removal of the wear member from the support structure when the pin assembly is in the inserted position. In some implementations, the lock assembly is biased radially inwardly against at least one of the cam or the pin body such that a distal face of the lock assembly is positioned against at least one of a cam outer profile or a pin body outer profile. The lock assembly may include: a base plate threadably received by the second bore; a follower; and a resilient member, wherein the resilient member extends between the base plate and the follower, and wherein the follower is biased radially inwardly against the cam by the resilient member.

In some implementations, the first bore extends longitudinally along a longitudinal axis of the main body, and wherein the second bore extends transverse to the longitudinal axis. The pin body may include a lock assembly recess shaped and sized complementary to at least a portion of the lock assembly such that the lock assembly recess receives at least a portion of the lock assembly when the pin assembly is in the inserted position and the rotatable shaft is in the locked position. The pin body may include: a trailing portion configured to engage an implement; a leading portion configured to interface with the lock assembly; and a central portion extending from the trailing portion and including a plurality of pin assembly threads complementary to a plurality of main body threads extending along an inner surface of the first bore. In some implementations, the leading portion and/or the central portion may be tapered inward toward a leading end of the pin body.

In some implementations, the lock pin assembly further includes a limit pin extending from one of the pin body inner face or the cam, and the other of the pin body inner face or the cam includes a limit pin race, wherein the limit pin race is configured to receive the limit pin, and wherein the limit pin race is sized and positioned to constrain rotation of the cam to rotation between the locked position and the unlocked position. The lock pin assembly may include two pin assemblies (e.g., the pin assembly and a second pin assembly) and two lock assemblies (e.g., the lock assembly and a second lock assembly), wherein the main body includes a third bore extending longitudinally inwardly from an outer face of the main body opposite the first bore, wherein the main body includes a fourth bore extending transverse to the third bore radially inwardly to an intersection with the third bore, wherein the third bore is configured to threadably receive one of the two pin assemblies, and wherein the fourth bore is configured to receive one of the two lock assemblies.

According to another exemplary aspect, the present disclosure is directed to a method for securing a wear member to support structure using a lock pin assembly, wherein the wear member includes a first opening alignable with a second opening in the support structure. The method may include: positioning the lock pin assembly within the second opening in the support structure, wherein the lock pin assembly includes a main body; introducing a pin assembly in the first opening of the wear member and threadably disposing the pin assembly in a first bore of the main body at an inserted position, wherein the first bore extends longitudinally inwardly from an outer face of the main body along a longitudinal axis of the main body, and wherein the pin assembly extends into or through at least a portion of the second opening when the pin assembly is in the inserted position; and rotating a rotatable shaft from an unlocked position to a locked position, wherein the rotatable shaft extends longitudinally through a pin body of the pin assembly from a pin body outer face to a pin body inner face, wherein the rotatable shaft is rotationally coupled to a cam proximal the pin body inner face, and wherein the cam interfaces with a lock assembly extending from a second bore such that when the rotatable shaft is in the locked position the lock assembly inhibits the pin assembly from rotating and moving from the inserted position.

In some implementations, the method further includes: threadably disposing a second pin assembly in a third bore at an inserted position of the second pin assembly, wherein the third bore extends longitudinally inwardly from a main body outer face opposite the first bore; and rotating a rotatable shaft of the second pin assembly from an unlocked position to a locked position, wherein a cam of the second pin assembly interfaces with a second lock assembly extending from a fourth bore such that when the second pin assembly is in the inserted position and rotatable shaft of the second pin assembly is in the locked position the second lock assembly inhibits the second pin assembly from rotating and moving from the inserted position of the second pin assembly.

According to another exemplary aspect, the present disclosure is directed to a method for removing a wear member from a support structure using a lock pin assembly, wherein the wear member includes a first opening alignable with a second opening in the support structure. The method may include: rotating a rotatable shaft from a locked position to an unlocked position, wherein the rotatable shaft extends longitudinally through a pin body of the pin assembly from a pin body outer face to a pin body inner face, wherein the rotatable shaft is rotationally coupled to a cam proximal the pin body inner face, and wherein the cam interfaces with a lock assembly extending from a second bore such that, when the rotatable shaft is in the locked position and the pin assembly is in an inserted position, the lock assembly inhibits the pin assembly from rotating and moving from the inserted position and, when the rotatable shaft is in the unlocked position and the pin assembly is in the inserted position, the lock assembly allows the pin assembly to rotate and move from the inserted position in a removal direction; threadably removing the pin assembly from a first bore of a main body of the lock pin assembly, wherein the first bore extends longitudinally inwardly from an outer face of the main body along a longitudinal axis of the main body, and wherein the pin assembly extends into at least a portion of the second opening when the pin assembly is in the inserted position; and removing the lock pin assembly from the second opening in the support structure.

In some implementations, the method further includes: rotating a rotatable shaft of a second pin assembly in a third bore from a locked position to an unlocked position, wherein a cam of the second pin assembly interfaces with a second lock assembly extending from a fourth bore such that when the rotatable shaft of the second pin assembly is in the locked position and the second pin assembly is in an inserted position the second lock assembly inhibits the second pin assembly from rotating and moving from the inserted position of the second pin assembly; and threadably removing the second pin assembly from the third bore, wherein the third bore extends longitudinally inwardly from a main body outer face opposite the first bore.

It is to be understood that both the foregoing general description and the following drawings and detailed description are exemplary and explanatory in nature and are intended to provide an understanding of the present disclosure without limiting the scope of the present disclosure. In that regard, additional aspects, features, and advantages of the present disclosure will be apparent to one skilled in the art from the following.

BRIEF DESCRIPTION OF THE DRAWINGS

The accompanying drawings illustrate implementations of the systems, devices, and methods disclosed herein and together with the description, serve to explain the principles of the present disclosure.

Figure 1:
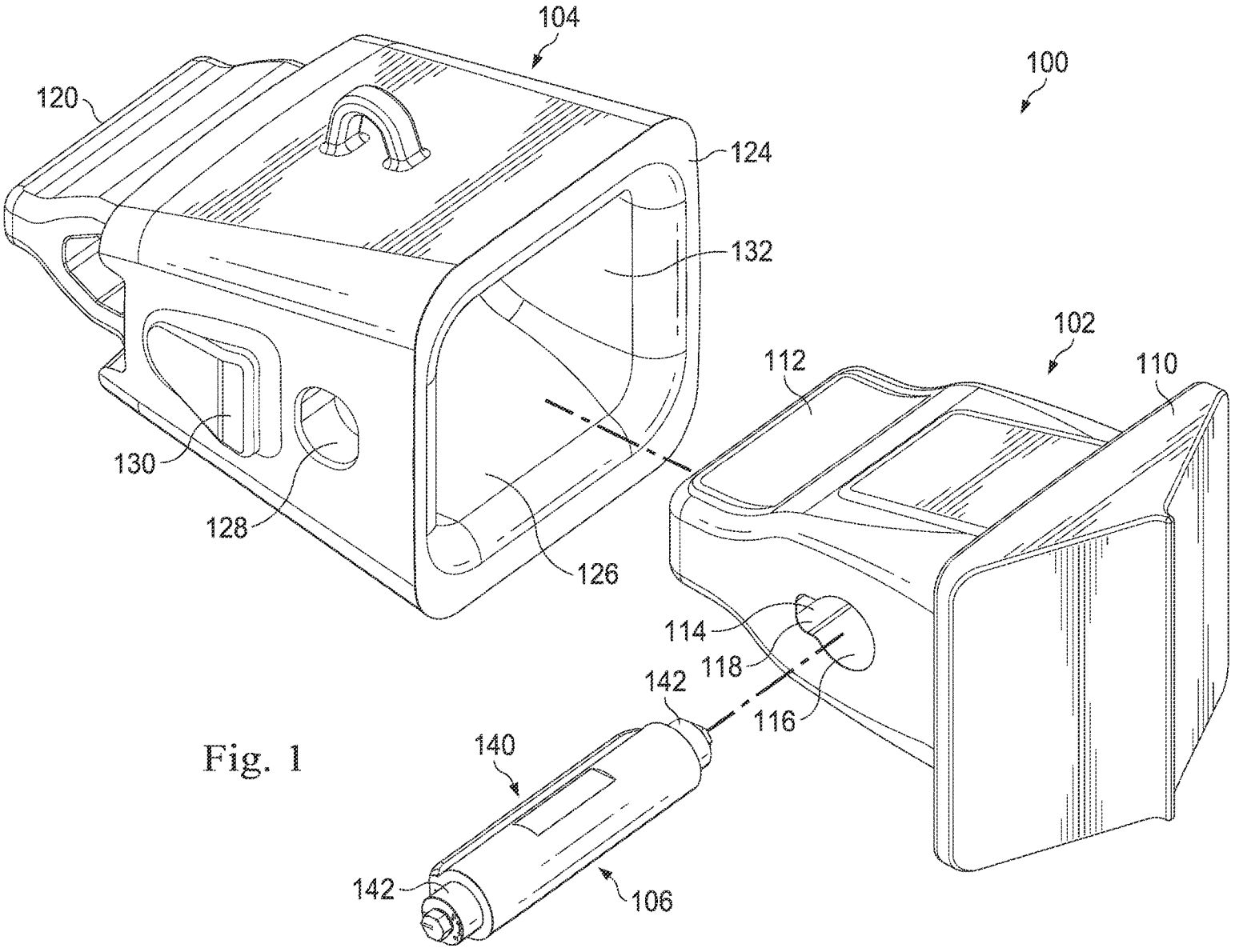
FIG. 1 is an exploded perspective view of an excavating tooth assembly embodying principles of the present disclosure.

These Figures will be better understood by reference to the following Detailed Description.

DETAILED DESCRIPTION

For the purposes of promoting an understanding of the principles of the present disclosure, reference will now be made to the implementations illustrated in the drawings and specific language will be used to describe them. It will nevertheless be understood that no limitation of the scope of the disclosure is intended. Any alterations and further modifications to the described devices, instruments, methods, and any further application of the principles of the present disclosure are fully contemplated as would normally occur to one skilled in the art to which the disclosure relates. In addition, this disclosure describes some elements or features in detail with respect to one or more implementations or Figures, when those same elements or features appear in subsequent Figures, without such a high level of detail. It is fully contemplated that the features, components, and/or steps described with respect to one or more implementations or Figures may be combined with the features, components, and/or steps described with respect to other implementations or Figures of the present disclosure. For simplicity, in some instances the same or similar reference numbers are used throughout the drawings to refer to the same or like parts.

The present disclosure is directed to an excavating tooth assembly including a lock pin assembly that is arranged to statically and removably secure a wear member, such as an intermediate adapter or excavating tooth, to a support structure, such as an adapter. In some implementations, the lock pin assembly includes a main body sized to be positioned within a bore or a passageway of the adapter and a pair of pin assemblies threadably disposed within axially opposed first bores extending within the main body. The lock pin assembly may include a pair of lock assemblies that are radially displaceable to mechanically prevent the pin assemblies from inadvertently moving from a locked position to an unlocked position and from being removed from an inserted position within the main body. Each of the pin assemblies may include a cam that may radially compress a respective lock assembly in the unlocked position or may allow the lock assembly to extend into a pin recess within the pin body in the locked position. When a respective lock assembly has been radially compressed by the cam when the pin assembly is in the unlocked position, the pin assembly may be threadably removed from within the first cavity of the main body and the wear member (or other implement) may be removed from the adapter (or other support structure) when both of the pin assemblies have been removed from the main body. Some implementations of the excavating tooth assembly include two lock pin assemblies that each extend into opposing bores in the support structure, with each lock pin assembly including a main body and a single pin assembly.

Since the lock pin assembly employs mechanical interference to prevent inadvertent rotation of lock pin assembly components, the lock pin assembly may be able to withstand vibration, high-impact, and cyclic loading while minimizing the chance of becoming inadvertently unlocked. In addition, some implementations of the lock pin assembly may be arranged to mechanically engage the pin body to prevent rotation of the pin body in either a clockwise or a counterclockwise direction when the pin assembly achieves a locked condition. Because of this, users such as machinery operators may be able to more rapidly install and verify a locked condition of the lock pin assembly when installing new wear members and replacing worn wear members as compared with conventional connector pins.

FIG. 1 shows an exemplary implementation of an excavating tooth assembly 100 including a support structure representatively in the form of an adapter 102, a wear member representatively in the form of an intermediate adapter 104, and a lock pin assembly 106. The excavating tooth assembly 100 may have particular utility on earth moving equipment. For example, the excavating tooth assembly 100 may be used in construction, mining, drilling, and other industries. The adapter 102 has a rear base portion 110 from which a nose portion 112 forwardly projects, the nose portion 112 having a horizontally elongated elliptical cross-section along its length and having a connector opening 114 extending therethrough. In the example of FIG. 1, the connector opening 114 is a non-circular transverse opening extending horizontally between the opposite vertical sides of the nose portion 112. In other implementations, the connector opening may extend vertically through the adapter 102. The connector opening 114 may extend as a passageway through the nose portion 112 or may have two opposing bores extending from side or top surfaces into the nose portion. Some implementations have a single bore that may extend from one surface, such as the top surface or other surface.

The base portion 110 may include structure for connecting to earth working equipment, such as a bucket, ripper, or other equipment for example. The connector opening 114 may have a curvilinear outer profile including a circular portion 116 and a keyway-shaped portion 118. Although the connector opening 114 is shown as having circular and keyway-shaped portions 116, 118, other shapes may be used such as circular, elliptical, or oblong shapes with or without cutout portions that may be used that facilitate operation of the lock pin assembly 106 as described herein.

The replaceable intermediate adapter 104 has a front end 120, a rear end 124 through which a nose-receiving socket 126 forwardly extends, and a horizontally opposed pair of horizontally elongated elliptical connector openings 128 extending inwardly into the interior of the socket 126 through opposing walls of the replaceable intermediate adapter 104. The intermediate adapter 104 may be replaced with a tooth point as a wear member, or a tooth point may be secured to the intermediate adapter 104 using the lock pin assembly 106 described herein. In such implementations, the intermediate adapter 104 may be considered a support structure and the tooth point may be considered the wear member. In the implementation shown, the intermediate adapter 104 may include thickened external boss portions 130 adjacent the elliptical connector openings 128. The interior surface of the socket 126 may have a configuration substantially complementary to the external surface of the adapter nose portion 112.

The lock pin assembly 106 includes a main body 140 and a pair of lock assemblies 142 which will be further discussed below. In some implementations, the lock pin assembly 160 is sized and shape to be removably disposed in the connector opening 114 and extend into or through the elliptical connector openings 128 to connect the adapter 102 to the replaceable intermediate adapter 104, and to mechanically prevent removal of the intermediate adapter 104 from the adapter 102.

As shown in FIGS. 2-9, the lock pin assembly 106 functions to removably secure the intermediate adapter 104 in a working position on the adapter 102. In this implementation, the lock pin assembly 106 includes a pair of oppositely extending pin assemblies 200 which are threadably received within a main body 202 of the lock pin assembly 106 to an inserted position 204. The main body 202 may be positioned within the connector opening 114 prior to introducing the intermediate adapter 104 over the nose 112 of the adapter 102. When the pin assemblies 200 are not positioned within respective bores of the main body 202, the intermediate adapter 104 may then be introduced over the lock pin assembly 106 and the nose portion 112 of the adapter 102. When the intermediate adapter 104 is properly positioned on the adapter 102, the pair of pin assemblies 200 may be introduced through the connector openings 128 and positioned within the main body 202 of the lock pin assembly 106. When the pin assemblies 200 are positioned in the inserted position 204, the lock pin assembly 106 may prevent removal of the intermediate adapter 104 from the adapter 102 by mechanically blocking the intermediate adapter 104. Additionally, as will be described further below, the pin assemblies 200 cooperate with at least a portion of the lock pin assembly 106 to inhibit the pin assemblies 200 from being removed from the main body 202. When desired, a user, such as an operator, may unlock each of the pin assemblies 200 which permits the user to remove the pin assemblies 200 from the main body 202 and the intermediate adapter 104 from the adapter 102.

The lock pin assembly 106 includes, among other components, the main body 202 including a rotation resisting element 206. The main body 202 has a non-circular outer perimeter that, in this exemplary implementation, corresponds with a shape of the connector opening 114 in the adapter 102. Accordingly, the main body 202 is formed with a semi-circular shape that includes the rotation resisting element 206 extending radially outward from a circular portion of the main body 202. In some implementations, the main body 202 may not include the rotation resisting element 206. In this exemplary implementation, the main body 202 is sized and shaped to have a clearance fit within the connector opening 114, while simultaneously utilizing the rotation-resisting element to prevent rotation of the main body 202 relative to the adapter 102 and to retain the main body 202 within the connector opening 114. In the latter regard, the connector opening 128 in the intermediate adapter 104 may have a width narrower than a width of the main body 202 at its widest point including the rotation resisting element 206 (see, e.g., FIG. 11).

In some implementations, the rotation resisting element 206 of the lock pin assembly 106 is mechanically attached to the adapter 102 by one or more of welding, bolting, adhesive, or other mechanical attachment. In other embodiments, the rotation resisting element 206 is formed as an integral part of the adapter 102, such as the adapter 102 and rotation resisting element 206 being formed from a single piece of metal.

Figure 2:
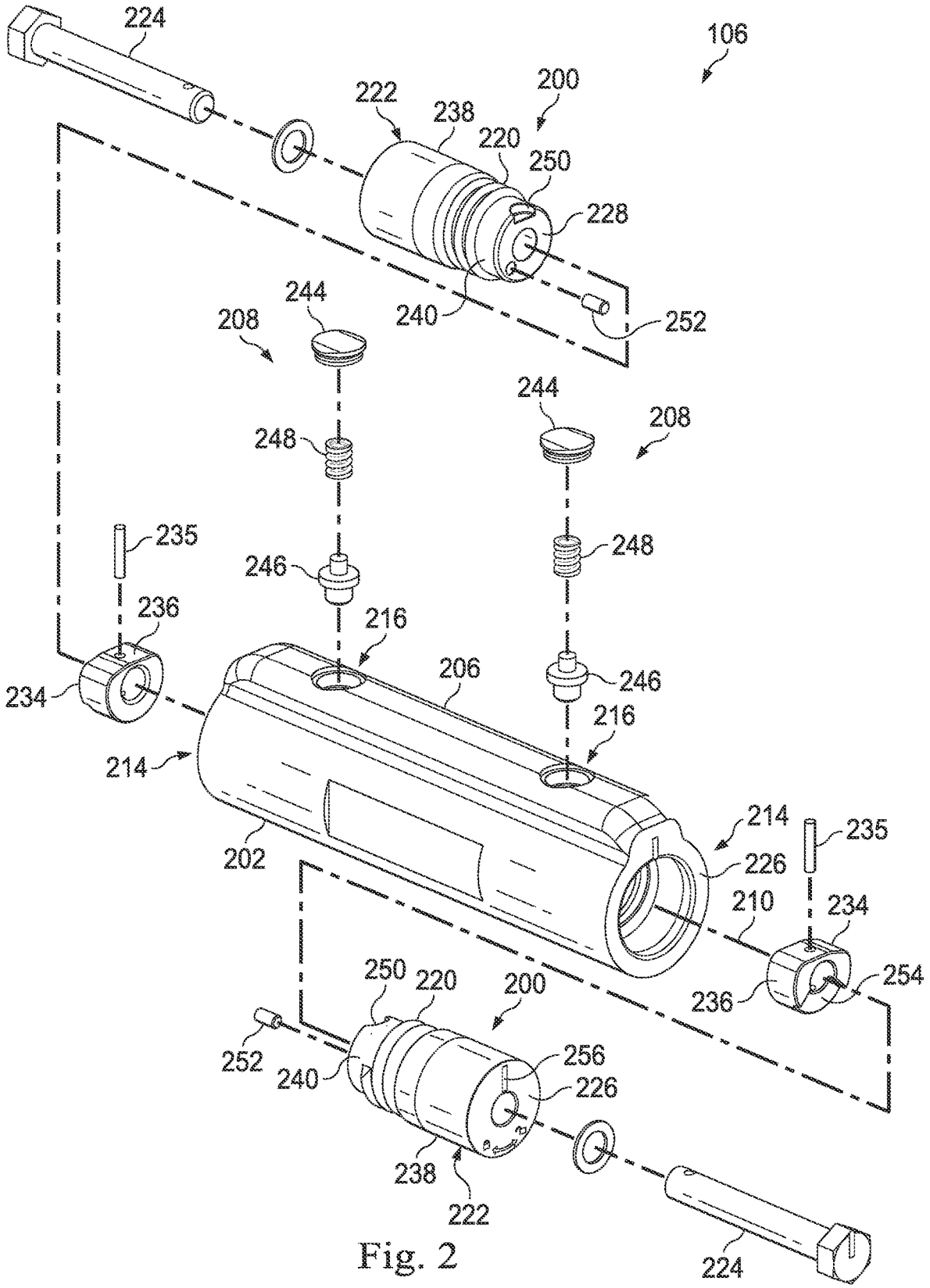
FIG. 2 is an exploded perspective view of an example lock pin assembly embodying principles of the present disclosure.

The main body 202, the rotation resisting element 206, and other components of the lock pin assembly 106 may best be seen in the exploded view of FIG. 2. As shown in FIG. 2, the lock pin assembly 106 may include the main body 202, a pair of pin assemblies 200, and a pair of lock assemblies 208, each of which will be described in further detail below.

With continued reference to FIGS. 2-9, the main body 202 is sized and shaped to mechanically interface with the connector opening 114 of the adapter 102 as indicated with reference to FIG. 1. Accordingly, as described above, the main body 202 has a non-circular peripheral profile that prevents rotation of the main body 202 relative to the adapter 102 when the main body 202 is positioned in the connector opening 114 (FIG. 1). In this exemplary implementation, the main body 202 has a longitudinal axis 210 extending through the center of the circular portion of the main body 202. The main body 202 includes a pair of opposing main body outer faces 212, and further includes a pair of first bores 214 extending longitudinally inwardly along the longitudinal axis 210 from the opposing main body outer faces 212. In this implementation, each of the pair of first bores 214 are blind bores. In at least some implementations, the pair of first bores 214 may form a single continuous through-bore. In the example implementation, a pair of second bores 216 may extend transverse to the longitudinal axis 210 through the rotation resisting element 206. In some implementations, the second bores 216 may extend transverse or perpendicularly to the longitudinal axis. In some implementations, each of the transverse second bores 216 may be angled relative to a perpendicular axis. For example, the transverse second bores 216 may be angled relative to the perpendicular axis by an angle within a range of about 0.5-15 degrees, such as about 5, 10, or 15 degrees from perpendicular with respect to the longitudinal axis. Each of the pair of second bores 216 may extend through the main body 202 to an intersection with a respective one of the pair of first bores 214. In some implementations, each of the pair of second bores 216 may extend through any portion of the main body 202.

Each of the first bores 214 is sized and shaped to threadably receive one pin assembly 200. Specifically, each of the first bores 214 includes a plurality of main body threads 218 extending along an inner surface of each of the first bores 214. The plurality of main body threads 218 are sized and shaped complementary to a plurality of pin assembly threads 220 extending along a pin body 222 each of the pin assemblies 200. Each of the pin assemblies 200 is threadably disposable within a respective one of the first bores 214 to an inserted position 204. Each of the pin assemblies includes a rotatable shaft 224 extending longitudinally through the pin body 222 from a pin body outer face 226 to a pin body inner face 228 and rotatable between a locked position 230 and an unlocked position 230. A cam 234 is rotationally coupled to the rotatable shaft 224 and has a cam outer profile 236 that includes a flat portion and a curvilinear portion. The cam 234 is coupled to the rotatable shaft proximal the pin body inner face 228 and rotates in conjunction with the rotatable shaft 224 between the locked position 230 and the unlocked position 230. In this implementation, the cam 234 is coupled to the rotatable shaft using a pin 235, such as a cotter pin, bolt, weld, or other fastener or fastening technique.

In this implementation, when the assembled lock pin assembly 106 is positioned within the nose portion 112 at the inserted position 204, each of the pin assemblies 200 extends beyond a respective main body outer face 212 by a longitudinal distance. In this manner, at least a portion of the pin assemblies 200 mechanically interface with the intermediate adapter 104 to inhibit removal of the intermediate adapter 104 from the nose portion 112.

In this implementation, the pin body 222 includes several portions including a trailing portion 238, a leading portion 240 (which may be cylindrical or tapered), and a central portion 242 (which may be cylindrical or tapered). The trailing portion 238 is configured to be the portion of the pin assembly 200 that extends beyond the main body 202 and interfaces with the intermediate adapter 104. In this implementation, the trailing portion 238 is cylindrical in shape and may be fabricated from a material configured to yield a desired toughness and wear resistance. The leading portion 240 is configured to interface with a corresponding portion of the lock assembly 208 (e.g., follower 246) and may include a distal tapered portion with a smooth outer surface that is configured to facilitate a sliding friction condition between the pin body 222 and the lock assembly 208. The central portion 242 extends between the trailing portion 238 and the leading portion 240 and includes a threaded portion that includes the plurality of pin assembly threads 220 that are configured to interface with the complementary plurality of main body threads 218 in the first bore 214.

Each of the pair of second bores 216 is sized and shaped to receive one lock assembly 208. Specifically, each of the second bores 216 is a multi-diameter through bore. Each lock assembly 208 includes a base plate 244 threadably disposable within the second bore 216, a follower 246, and a biasing member 248 configured to bias the follower 246 away from the base plate 244 and into a respective one of the first bores 214. In this implementation, the biasing member 248 is a resilient member or a spring. In at least some implementations, the biasing member 248 may be fabricated from a resilient material configured to apply a force to the follower 246 that causes the follower 246 to be biased away from the base plate 244.

In this implementation, when a respective one of the pin assemblies 200 is positioned within a corresponding one of the first bores 214 at the inserted position 204, the follower 246 of the corresponding lock assembly 208 is biased radially inwardly such that a distal face of the follower 246 is positioned against the pin body 222. More specifically, when the pin assembly 200 is in the inserted position 204, the distal face of the follower 246 is positioned such that a portion of the follower 246 is in contact with the leading portion 240. In this implementation, the leading portion 240 includes a lock assembly recess 250 that is sized and shaped complementary to the follower 246 such that when the pin assembly 200 is in the inserted position 204 and the rotatable shaft is in the locked position 230, the lock assembly recess 250 receives at least a portion of the follower 246. In some implementations, at least a portion of the lock assembly recess 250 is disposed in the cam 234. In other implementations, the lock assembly 208 is disposed within the pin body 222 such that the lock assembly 208 is biased radially outward against the main body 202. In this case, the lock assembly recess 250 may be disposed in the main body 202.

Figure 9:
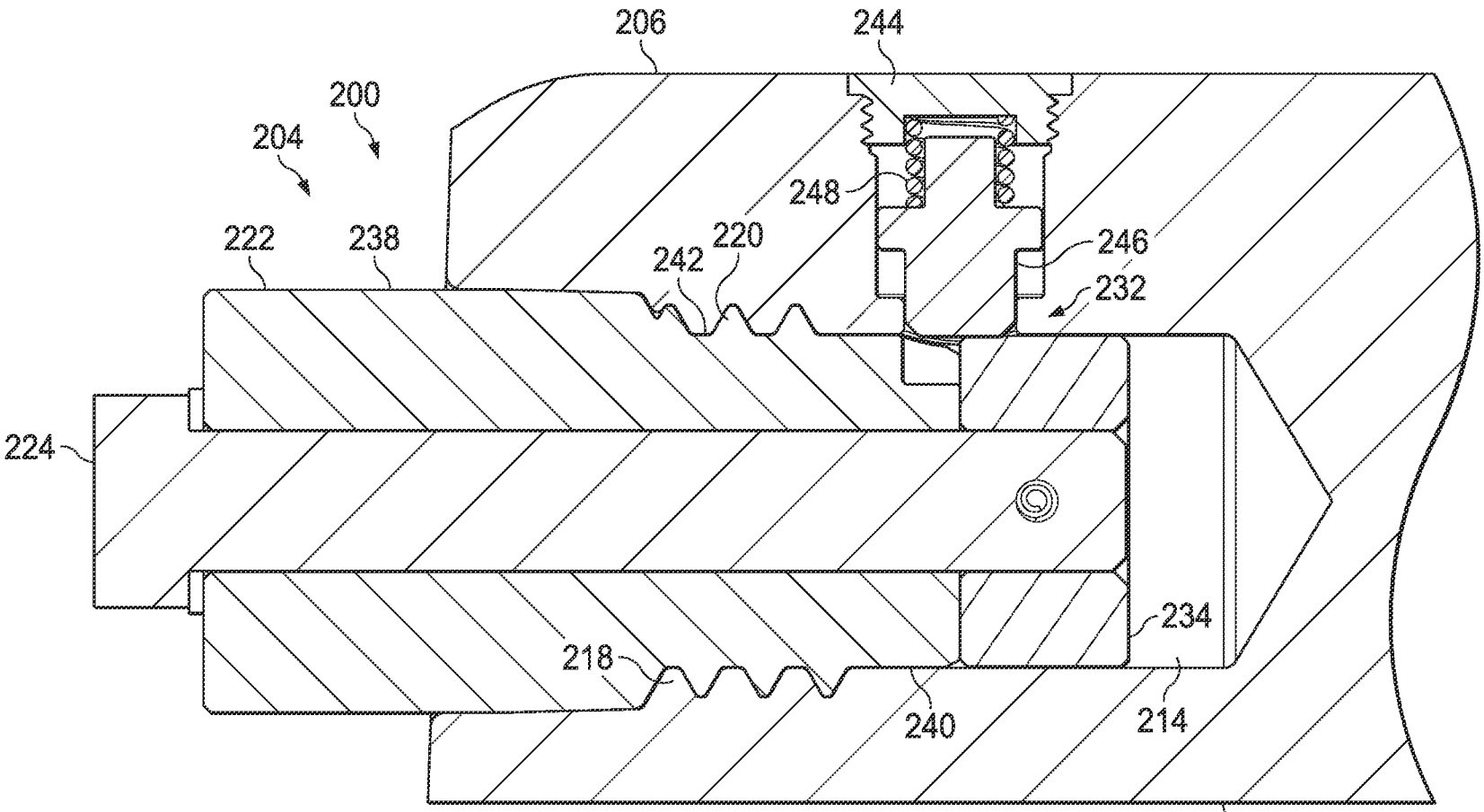
FIG. 9 is a cross-sectional partial plan view taken along lines 9-9 of FIG. 8 through the lock pin assembly with the pin assembly in the inserted position and the rotatable shaft in the unlocked position.

In the example implementation, a limit pin 252 extends between the pin body inner face 228 and the cam 234. More specifically, the limit pin 252 is fixed relative to the pin body 222 and extends within a limit pin race 254 extending along at least a portion of the cam 234. In this implementation, the limit pin race 254 is a triangular-shaped cutout that constrains a rotational range of motion of the cam 234, and therefore the rotatable shaft 224, to a rotational range of motion of about 60 degrees relative to the limit pin 252 and the pin body 222 and corresponding to the range of rotational motion between the locked position 230 and the unlocked position 230. Other implementations have a rotational range of motion of about 30 to 150 degrees, 45 to 120 degrees, and 50 to 90 degrees. The range of rotation of the cam 234 is defined by the boundaries of the limit pin race 254, which inhibit the cam 234 from rotating in one of a clockwise direction or a counterclockwise direction when a sidewall of the limit pin race 254 is in contact with the limit pin 252, as shown in FIGS. 2 and 9. In some implementations, the limit pin 252 may be fixed within or to the cam 234, or cast as an integral component of the cam, and the limit pin race 254 may extend along the pin body inner face 228. In additional implementations, the limit pin race 254 may be a track or groove having a width substantially similar to a diameter of the limit pin 252. In some implementations, the limit pin 252 is configured to translate rotational energy from the rotatable shaft 224 to the pin body 222, and in some instances, the limit pin 252 is the only connector between the rotatable shaft 224 and pin body 222. In some implementations, the cam 234 is configured to move the follower 246 in an upwards (i.e., radially outward) direction to unlock the lock assembly 208 when the cam 234 is rotated with the rotatable shaft 224 as the rotatable shaft is rotated to the unlocked position.

During positioning of the pin assembly 200 to the inserted position 204, and while the pin assembly 200 is positioned within the first bore 214, the rotatable shaft 224 is turned in a clockwise direction, causing the rotatable shaft 224 and the cam 234 to rotate relative to the pin body 222 until the limit pin 252 contacts a boundary of the limit pin race 254. Once the limit pin 252 contacts the boundary of the limit pin race 254, rotational motion, or torque, imparted to the rotatable shaft 224 is transferred to the pin body 222, causing the pin body 222 to rotate in conjunction with the rotatable shaft 224 and the cam 234 along the clockwise direction. The clockwise rotational motion of the pin assembly 200 causes the plurality of main body threads 218 to engage the plurality of pin assembly threads 220 and the pin assembly 200 to be drawn longitudinally inwardly towards the inserted position 204.

As the pin assembly 200 is threadably inserted into the first bore 214, the cam 234 interfaces with the follower 246 of the lock assembly 208 such that the cam outer profile 236 moves diagonally across the follower 246 as the cam is rotated about and advances along the longitudinal axis 210. The plurality of pin assembly threads 220, and the corresponding plurality of main body threads 218, are sized and positioned such that when the pin assembly 200 is threadably disposed at the inserted position 204, at least a portion of the follower 246 is aligned with and received by the lock assembly recess 250. Additionally, alignment marks 256 present along the main body outer face 212, the rotatable shaft 224, and the pin body outer face 226 are aligned with each other when the pin assembly 200 is in the inserted position 204 and the rotatable shaft 224 is in the locked position 230.

With continued reference to FIGS. 2-9, as the pin assembly 200 is threadably inserted into the first bore 214 by rotating the pin assembly 200 in a clockwise direction and the pin assembly 200 approaches the inserted position 204, the distal face of the follower 246 travels along the outer profile of the leading portion 240 of the pin body 222. When the pin assembly 200 has been threadably advanced into the inserted position 204, the lock assembly recess 250 is aligned with the follower 246 such that the follower 246 may be biased radially inwardly and at least a portion of the follower 246 is positioned within the lock assembly recess 250. In this implementation, the follower 246 of the lock assembly 208 inhibits rotation of the pin body 222, and therefore movement of the pin assembly 200 along the longitudinal axis, when the follower 246 is positioned within the lock assembly recess 250.

Figure 8:
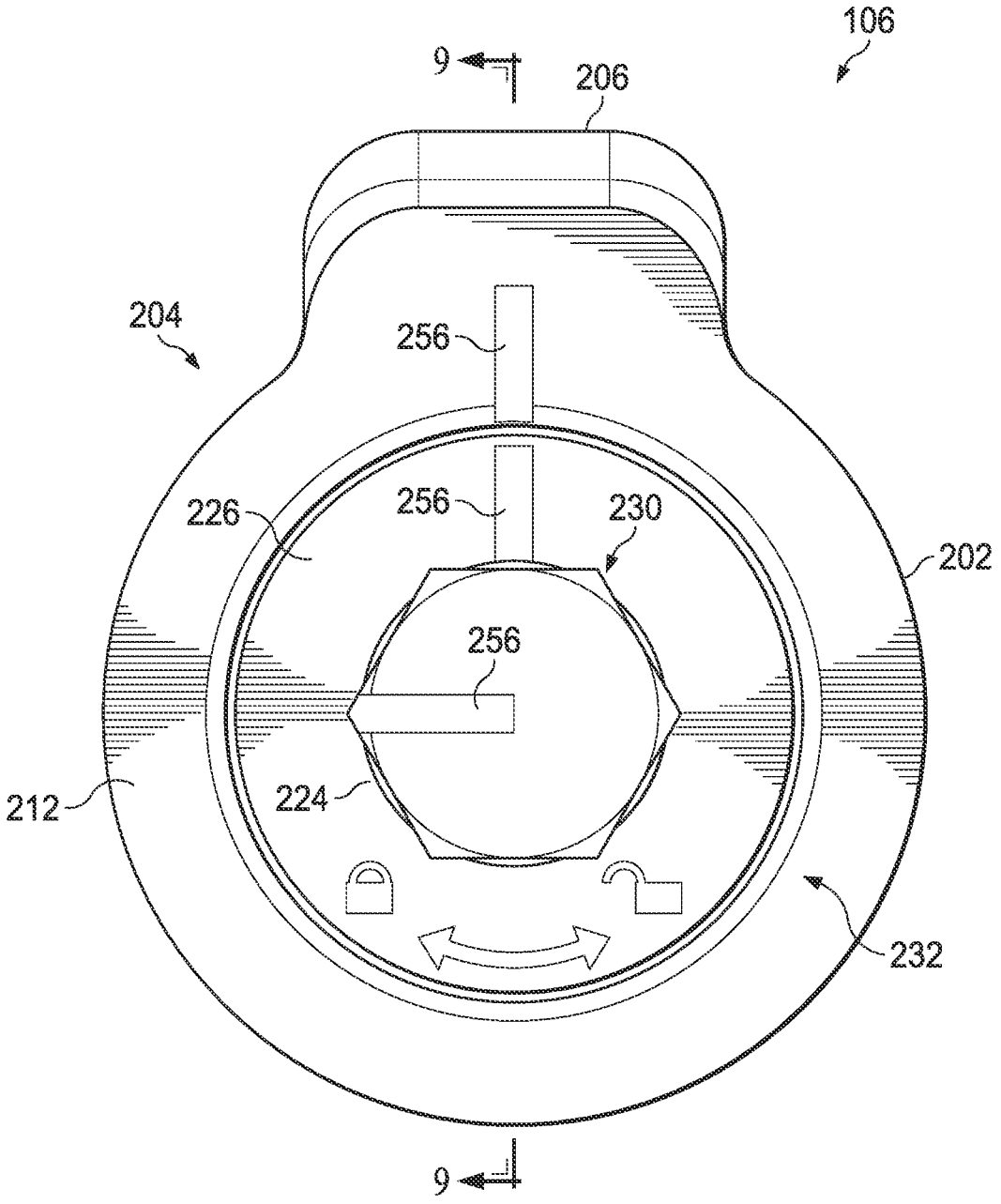
FIG. 8 is a side view of the lock pin assembly of FIG. 2 with the pin assembly in the inserted position and the rotatable shaft in an unlocked position.

In this implementation, to unlock the pin assembly 200, the rotatable shaft 224 may be rotated in a counterclockwise direction, as illustrated on the pin body outer face 226. As shown in FIGS. 8 and 9, when the rotatable shaft 224 has been rotated to the unlocked position 230, the curvilinear portion of the cam outer profile 236 is caused to interface with the distal face of the follower 246 such that the follower 246 is moved radially outwardly and away from the lock assembly recess 250. The rotatable shaft 224, and the rotationally-coupled cam 234, may rotate relative to the pin body 222 along the counterclockwise direction to the unlocked position 230 without causing a rotation of the pin body 222. Once the rotatable shaft 224 has been rotated to the unlocked position 230 and the outer perimeter of the limit pin race 254 interfaces with the limit pin 252 in the unlocked position 230, transmission of torque and rotational motion from the cam 234 to the pin body 222 is facilitated. Because the follower 246 is displaced from the lock assembly recess 250 by the cam 234 in the unlocked position 230, the pin assembly 200, including the pin body 222, may be threadably removed from the first bore 214. During removal of the pin assembly 200 from the first bore 214, the follower 246 travels circumferentially and longitudinally, relative to the cam 234, along the cam outer profile 236.

Figure 10A:
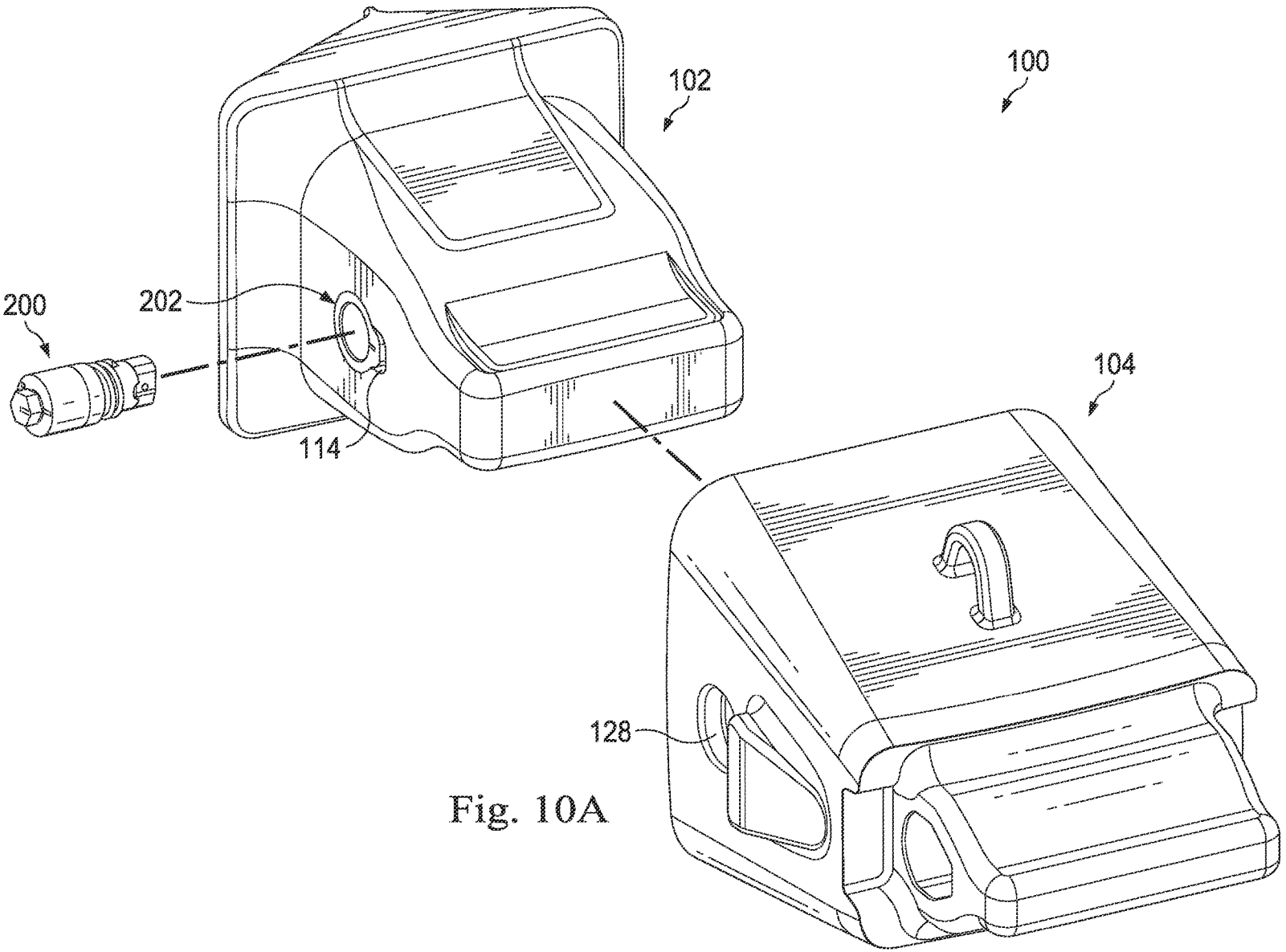
FIG. 10A is a perspective view of an excavating tooth assembly with the lock pin assembly disposed in an adapter in an unlocked position to receive a wear member.

Referring to FIG. 10A, the main body 202 of the lock pin assembly 106 shown in FIG. 2 is shown disposed within the non-circular transverse connector opening 114 of the adapter 102. In some implementations, the main body 202 is disposed within the adapter 102 before attaching the adapter 102 to the replaceable intermediate adapter 104. The pin assembly 200 may be aligned with the main body 202 to prepare for connecting the entire lock pin assembly 106 to releasably connect the adapter 102 to the replaceable intermediate adapter 104.

Figure 10B:
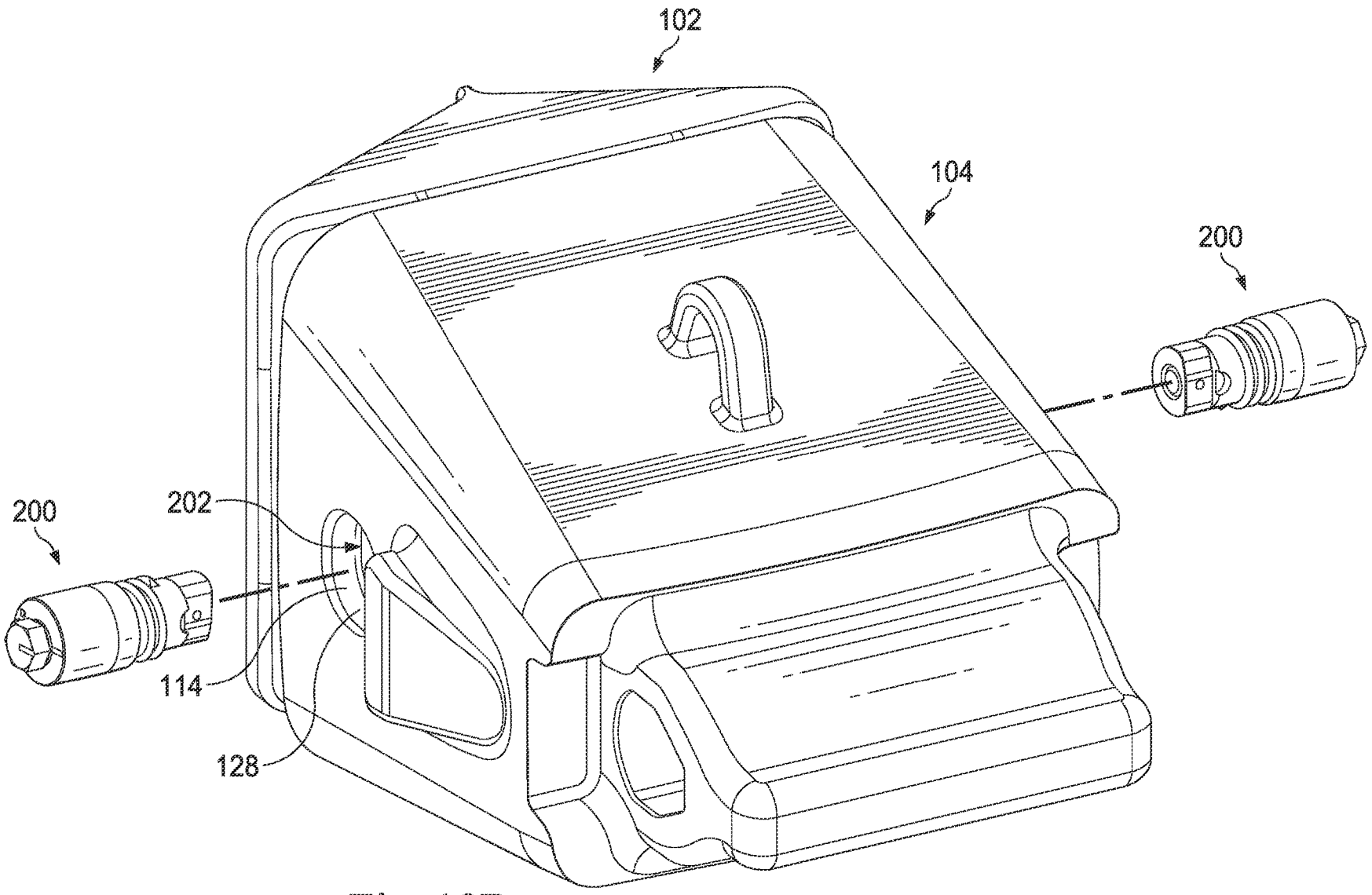
FIG. 10B is a perspective view of the excavating tooth assembly with the lock pin assembly disposed in the adapter connected to the wear member.

Referring to FIG. 10B, the replaceable intermediate adapter 104 is introduced over the adapter 102 such that the main body 202, the non-circular transverse connector openings 114 of the adapter 102, and the horizontally elongated elliptical connector openings 128 of the replaceable intermediate adapter 104 are aligned. The pin assemblies 200 may be introduced through the connector openings 114 and 128 and connected to the main body 202 to form the lock pin assembly 106 and releasably connect the adapter 102 to the replaceable intermediate adapter 104.

Figure 11:
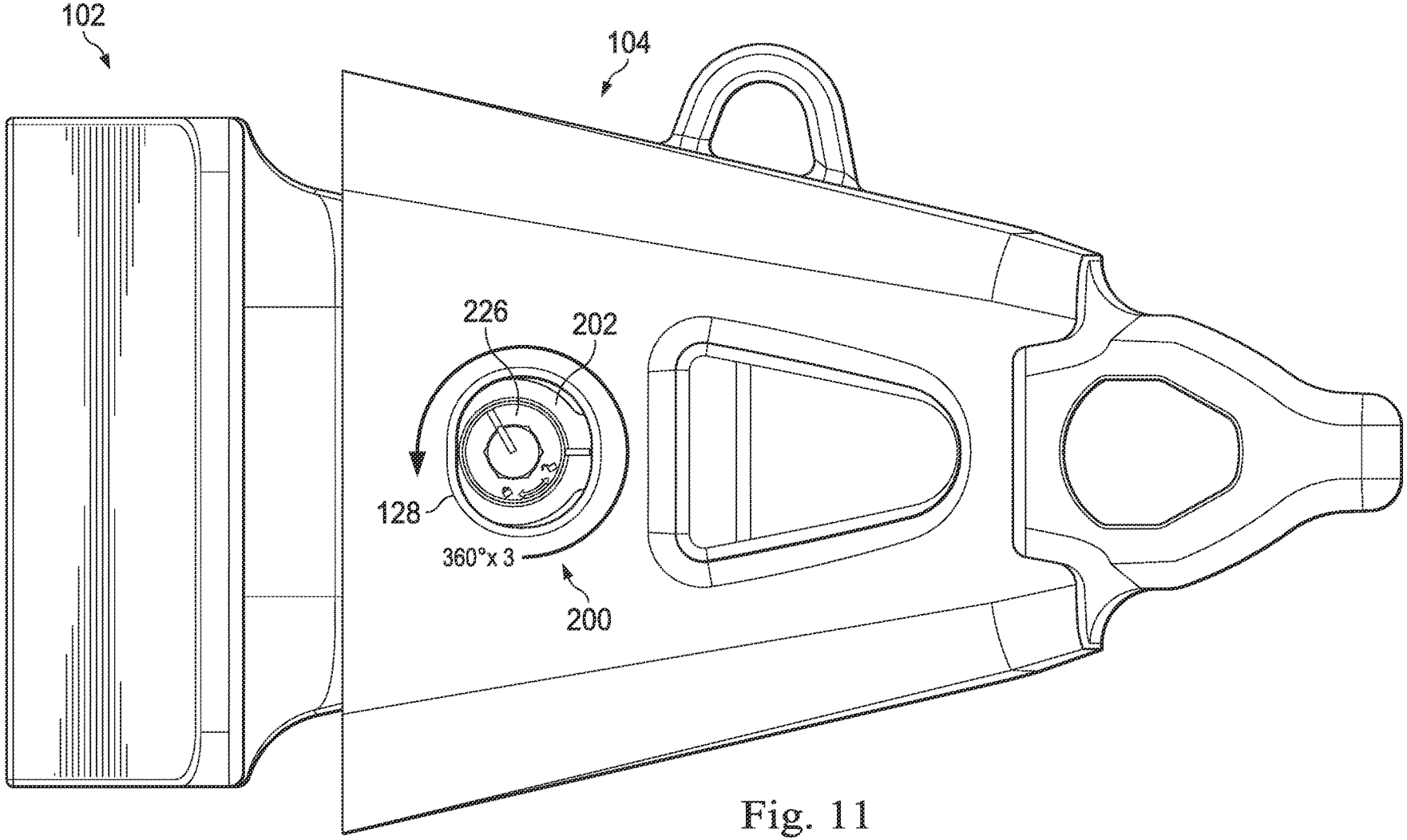
FIG. 11 is a side view showing the wear member assembled on the adapter with the lock pin assembly in an unlocked position and showing the movement required to change the lock pin assembly from the unlocked position to a locked position.

Referring to FIG. 11, the replaceable intermediate adapter 104 is assembled on the adapter 102 with the pin assembly 200 in an unlocked position. The rotational direction required to change the pin assembly 200 from the locked position to the unlocked position is shown and may include motion in a counterclockwise direction for about 90 degrees. Rotating the pin assembly 200 further in this direction to remove the pin assembly 200 starting from the inserted position may require three full turns (of 360 degrees each), although other rotational turn amounts are contemplated.

Figure 12:
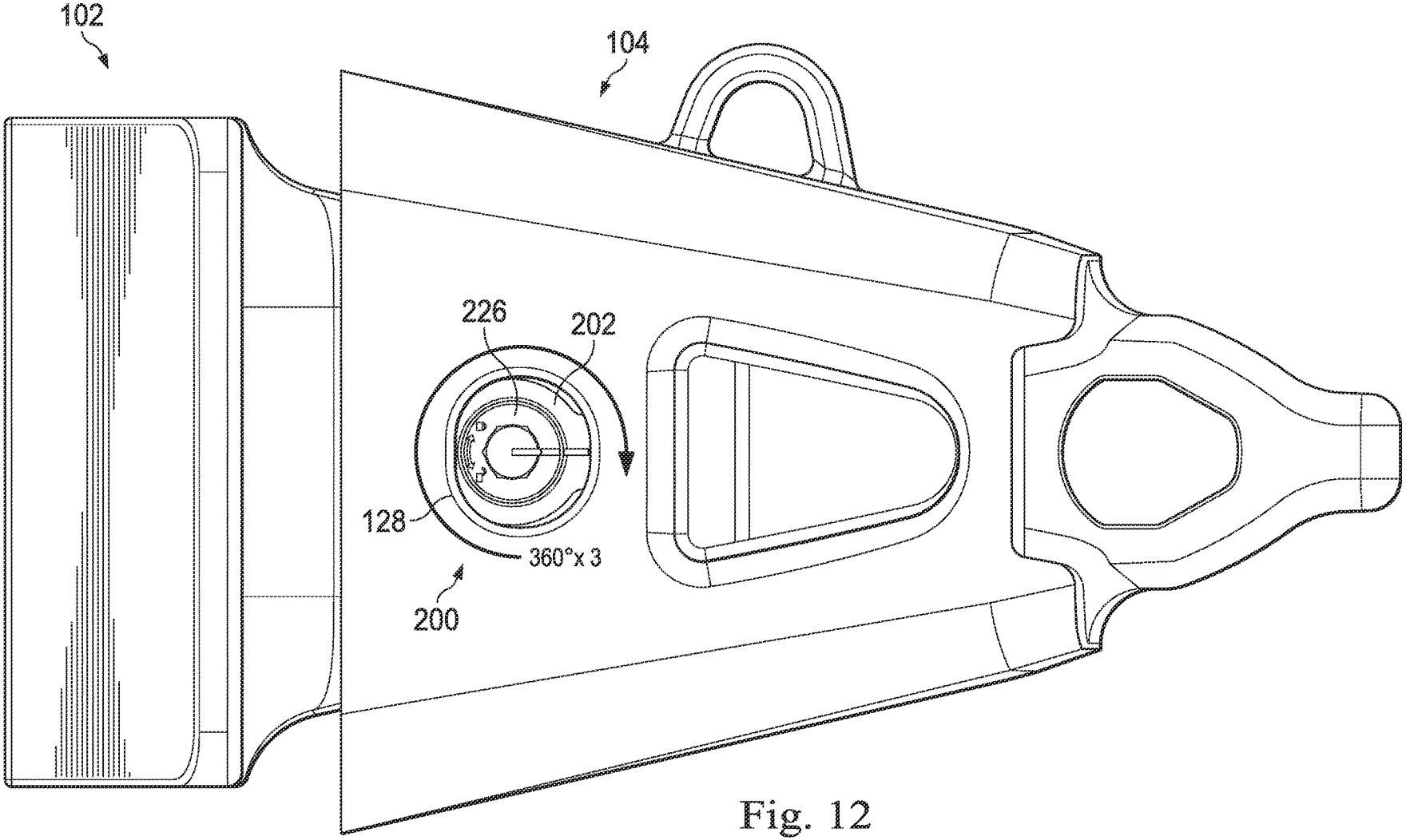
FIG. 12 is a side view showing the wear member assembled on the adapter with the lock pin assembly in a locked position and showing the movement required to change the lock pin assembly from the locked position to the unlocked position.

Referring to FIG. 12, the replaceable intermediate adapter 104 is assembled on the adapter 102 with the pin assembly 200 in the locked position. The rotational direction required to change the pin assembly 200 from the unlocked position to the locked position is shown and may include motion in a clockwise direction for about 90 degrees. Rotating the pin assembly 200 further in this direction to advance the pin assembly 200 to the inserted position may require three full turns (of 360 degrees each). In other implementations, the motion movement required to change the pin assembly from the locked to unlocked position (or vice versa) is more or less than three full turns.

Figure 13:
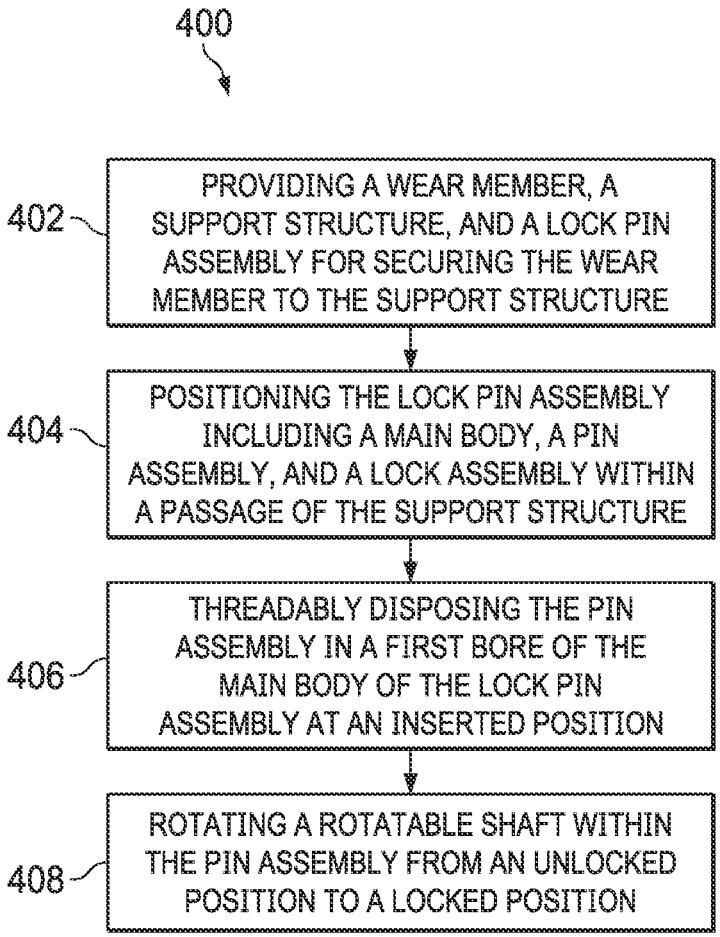
FIG. 13 is a flow chart of a method embodying principles of the present disclosure.

Referring to FIG. 13, a method 400 for securing a wear member to a support structure with a lock pin assembly is provided including a set of operations or steps 402 through 408. Not all of the illustrated steps 402 through 408 must be performed in all implementations of method 400. Additionally, one or more steps that are not expressly illustrated in FIG. 13 may be included before, after, in between, or as part of the steps.

The method 400 includes a step 402 to provide a wear member, a support structure, and a lock pin assembly for securing the wear member to the support structure. In some implementations, the wear member may be intermediate adapter 104, support structure may be adapter 102 and the lock pin assembly may be lock pin assembly 106 as depicted in FIG. 1. In some implementations, an outer portion of the lock pin assembly such as rotation resisting element 206 may be mechanically attached to the adapter. In some implementations, the rotation resisting element or other portion of the main body 202 may be integrally formed with the adapter.

The method 400 may include step 404 to position at least a portion of the lock pin assembly including a main body, a pin assembly, and a lock assembly within a passage of the support structure. For example, the main body with the lock assembly may be positioned within the passage or opening in the support structure. In some implementations, the main body is main body 202, the pin assembly is pin assembly 200, the lock assembly is lock assembly 208, and the passage of the support structure is opening 114 in adapter 102, as depicted in FIGS. 1 and 2.

Figure 3:
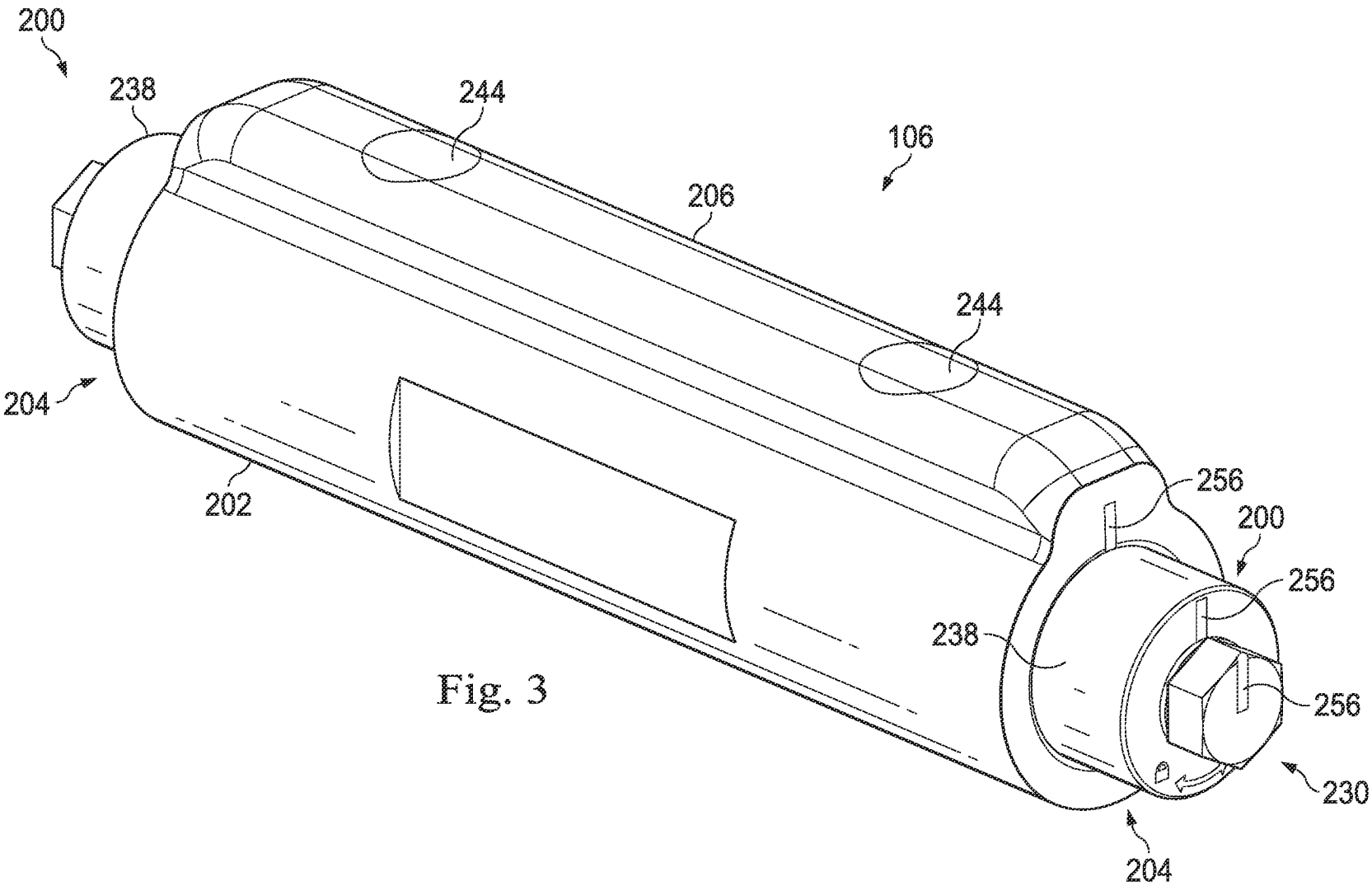
FIG. 3 is a perspective view of a lock pin assembly of FIG. 2 with a pin assembly in an inserted position and a rotatable shaft in a locked position.
Figure 4:
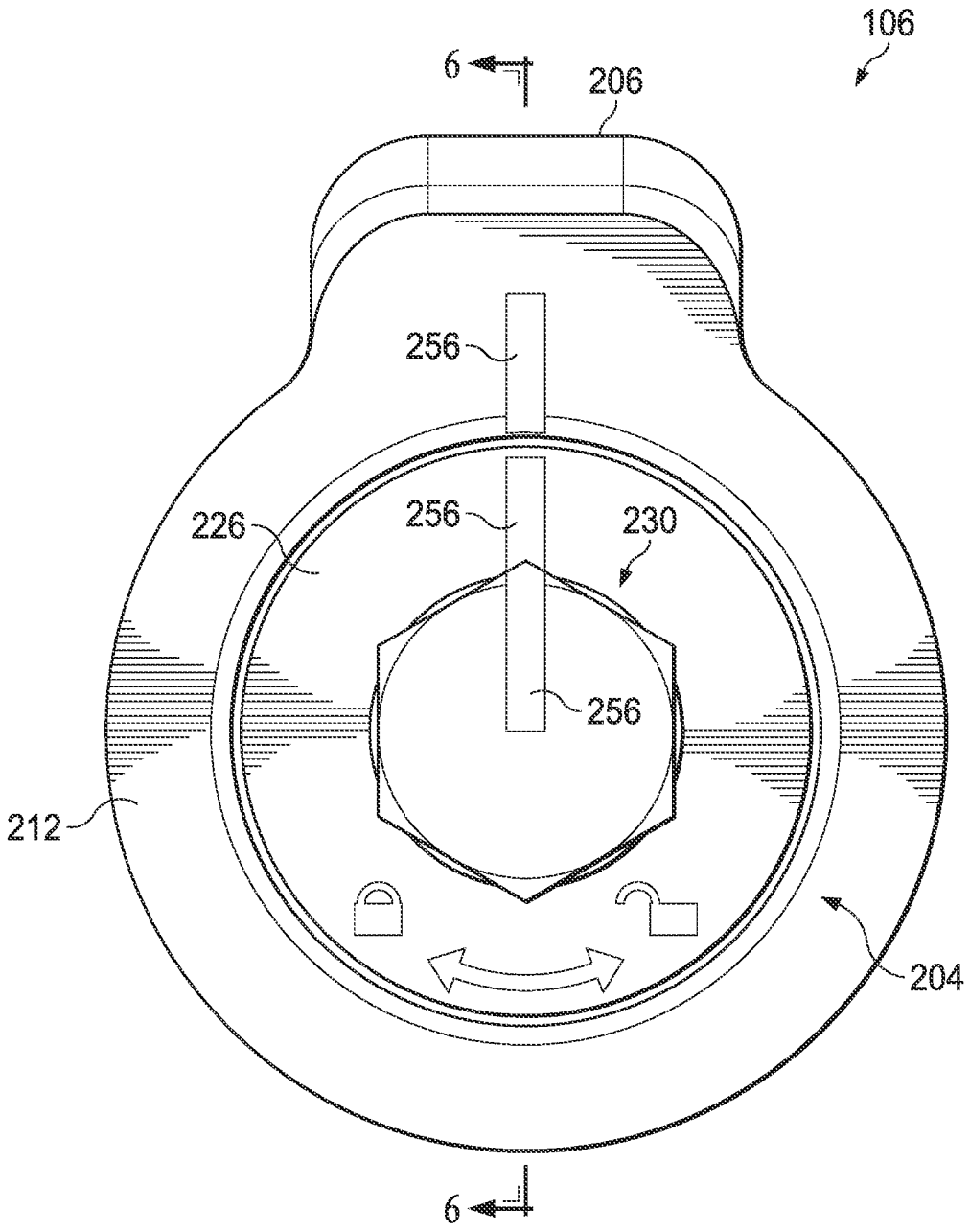
FIG. 4 is a side view of the lock pin assembly of FIG. 2 with the pin assembly in the inserted position and the rotatable shaft in the locked position.
Figure 5:
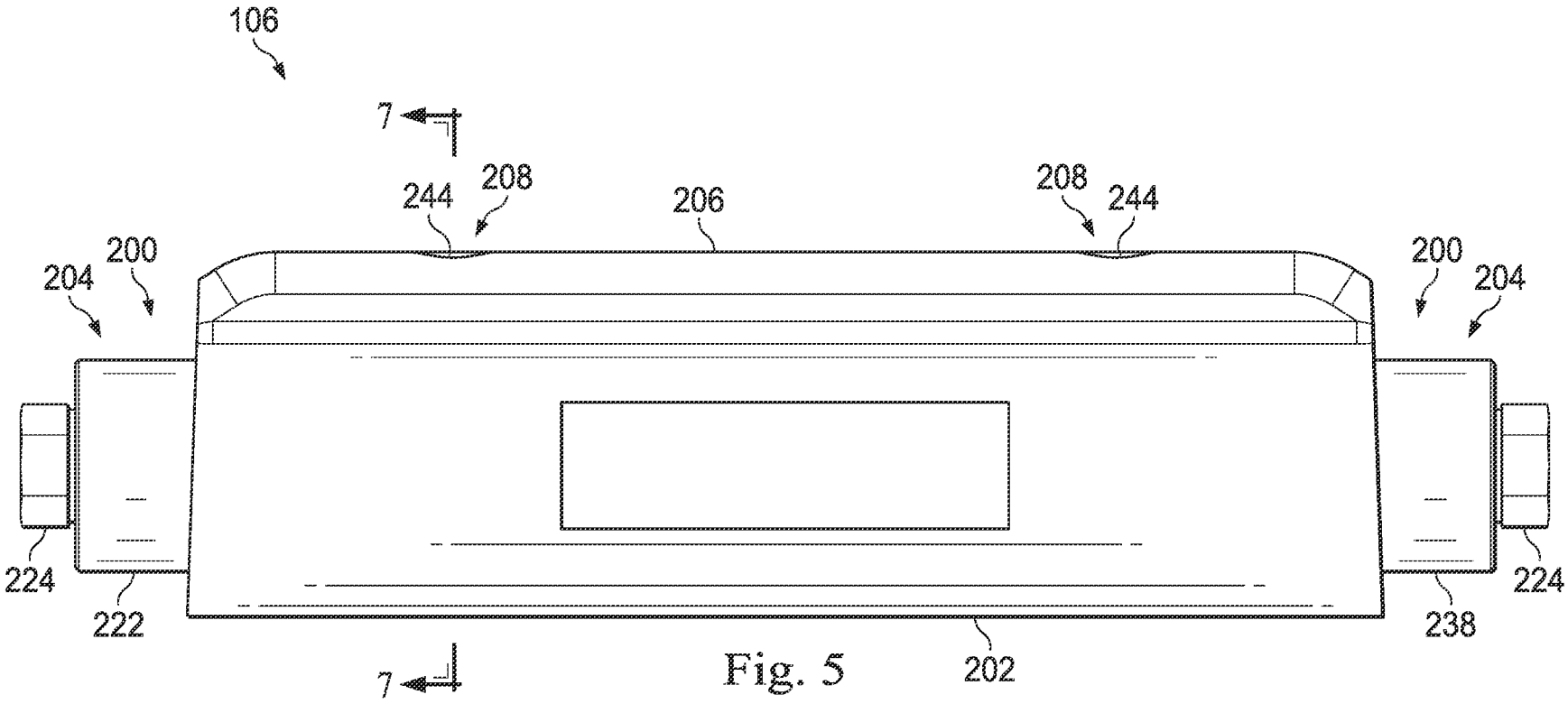
FIG. 5 is a plan view of the lock pin assembly of FIG. 2 with the pin assembly in the inserted position and the rotatable shaft in the locked position.
Figure 6:
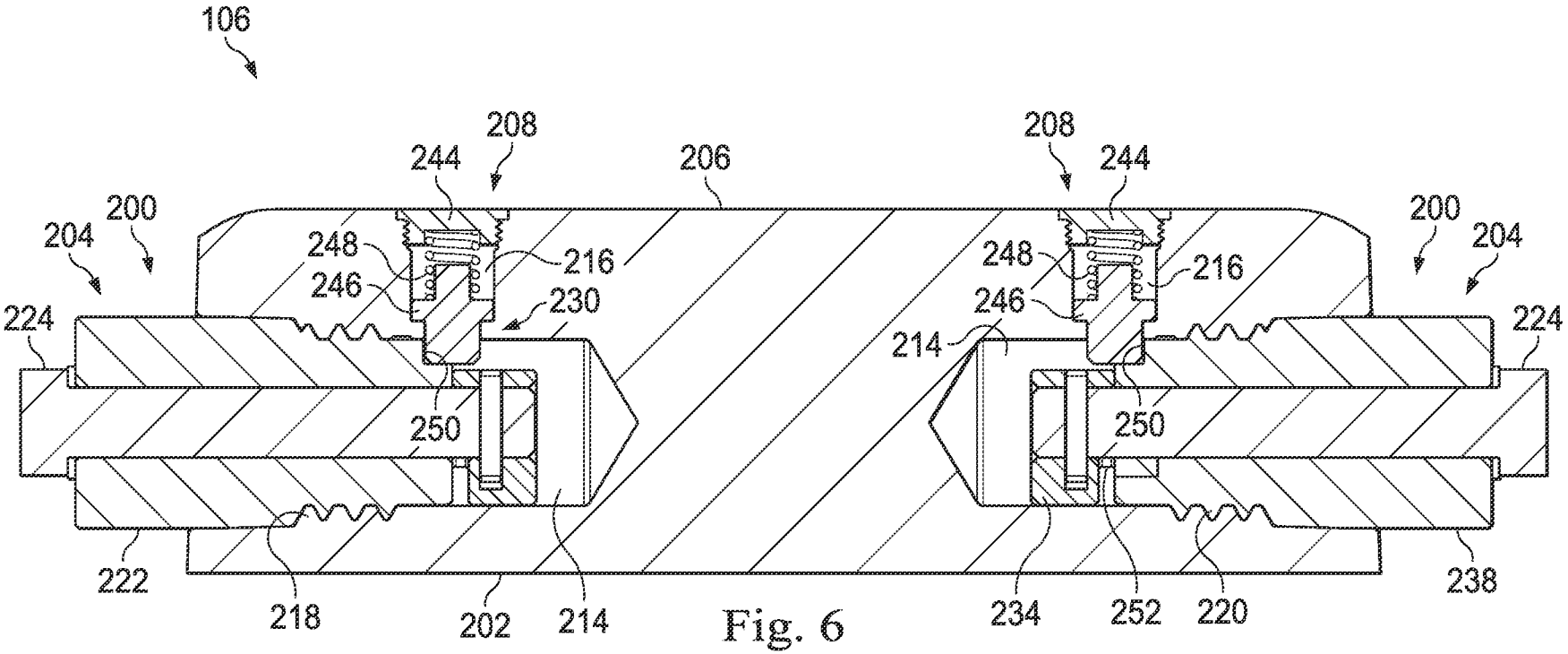
FIG. 6 is a cross-sectional plan view taken along lines 6-6 of FIG. 4 through the lock pin assembly with the pin assembly in the inserted position and the rotatable shaft in the locked position.
Figure 7:
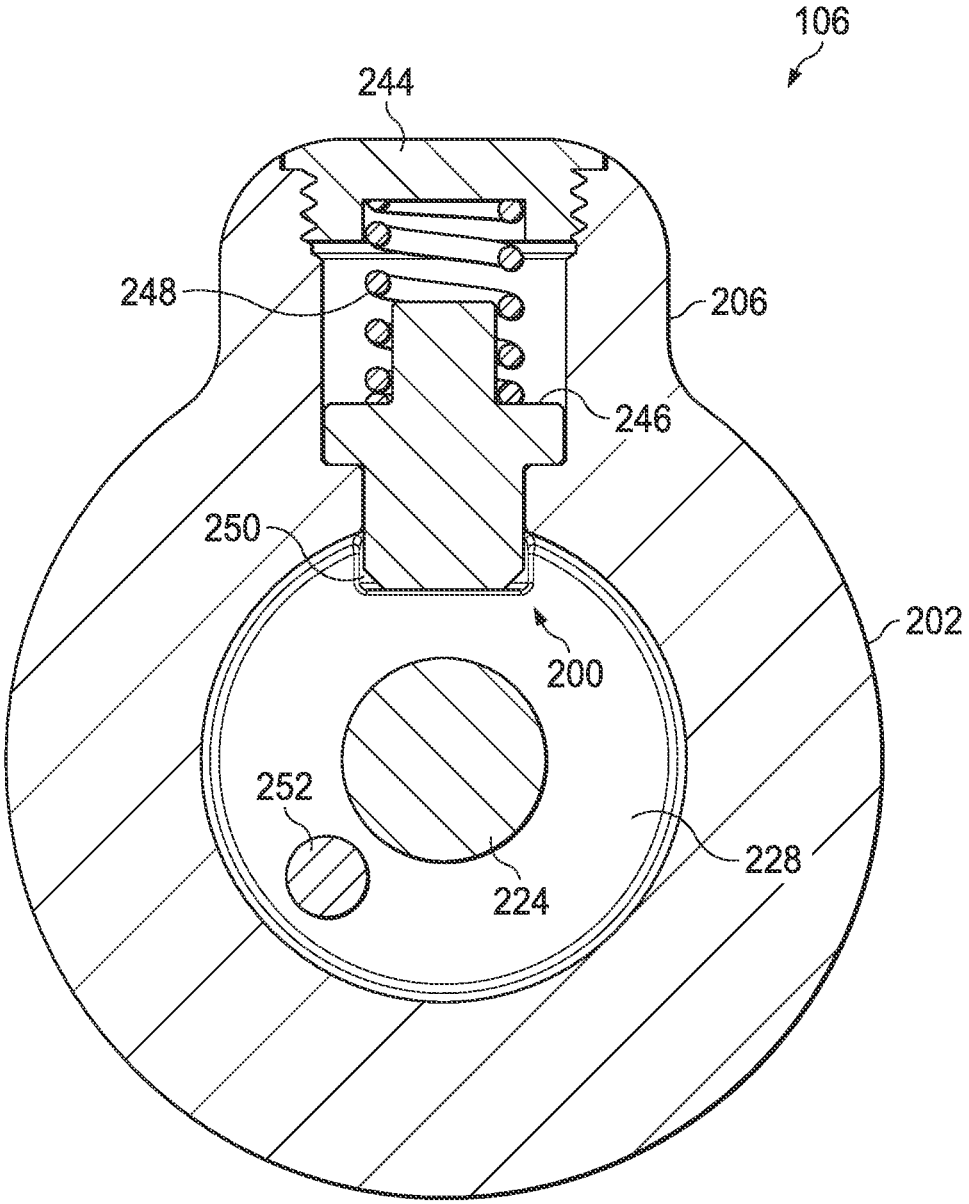
FIG. 7 is a cross-sectional side view taken along lines 7-7 of FIG. 5 through the lock pin assembly with the pin assembly in the inserted position.

The method 400 may include step 406 to threadably dispose the pin assembly in a first bore of the main body of the lock pin assembly in an inserted position. In some implementations, this step 406 includes threading the pin assembly 200 in a first bore, such as the first bore 214, of the main body to an inserted position, such as the inserted position 204 (as shown in FIG. 3). In this example, the first bore extends longitudinally inwardly from a main body outer face, such as the main body outer face 212, along a longitudinal axis, such as the longitudinal axis 210, of the main body, and the pin assembly extends into at least a portion of a side opening of a wear member when the pin assembly is in the inserted position.

The method 400 may include step 408 to rotate a rotatable shaft within the pin assembly from an unlocked position to a locked position. In some implementations, this step 408 may include rotating rotatable shaft 224, from an unlocked position, such as unlocked position 232 in FIG. 8, to a locked position, such as locked position 230 in FIG. 4. In this implementation, the rotatable shaft extends longitudinally through a pin body, such as the pin body 222, of the pin assembly from a pin body outer face, such as the pin body outer face 226, to a pin body inner face, such as the pin body inner face 228. Additionally, the rotatable shaft is rotationally coupled to a cam, such as the cam 234, proximal the pin body inner face and the cam interfaces with a lock assembly, such as the lock assembly 208, extending from a second bore, such as the second bore 216, such that when the rotatable shaft is in the locked position the lock assembly inhibits the pin assembly from rotating and moving from the inserted position.

The lock pin assemblies described herein may provide advantages and benefits not found in conventional devices. For example, because of the internal and radially inwardly biased lock assembly mechanically interfacing with a pin assembly body, the lock pin assembly may be more resistant to inadvertently overcoming the biasing force in order to unlock the pin assembly and then threadably removing the pin assembly during routine operation of the wear member and the support structure. For example, it may better withstand vibration, high impact, and cyclic loading conditions that may occur during use of ground engaging tools. While described with reference to an intermediate adapter and an adapter, it should be understood that the lock pin assembly may find use in other applications. For example and without limitation, the lock pin assembly may be used to attach an adapter to a bucket or other structures in the ground engaging tool industry.

Persons of ordinary skill in the art will appreciate that the implementations encompassed by the present disclosure are not limited to the particular exemplary implementations described above. In that regard, although illustrative implementations have been shown and described, a wide range of modification, change, combination, and substitution is contemplated in the foregoing disclosure. It is understood that such variations may be made to the foregoing without departing from the scope of the present disclosure. Accordingly, it is appropriate that the appended claims be construed broadly and, in a manner, consistent with the present disclosure.

What is claimed is:

1. A lock pin assembly comprising:

a main body including:

a first bore extending longitudinally inwardly from a main body outer face;

a second bore extending radially inwardly to an intersection with the first bore; and a pin assembly threadably disposable in the first bore to an inserted position, the pin assembly including:

a pin body having a pin body outer face and a pin body inner face;

a rotatable shaft extending longitudinally from the pin body outer face to the pin body inner face, wherein the rotatable shaft is rotatable between a locked position and an unlocked position;

a cam rotationally coupled to the rotatable shaft adjacent the pin body inner face; and a lock assembly disposed in the second bore, wherein the lock assembly is radially displaceable in the second bore and radially biased to inhibit removal of the pin assembly from the main body when the pin assembly is in the inserted position and the rotatable shaft is at the locked position.

2. The lock pin assembly of claim 1, wherein the pin body extends beyond the main body by a first longitudinal distance when the pin assembly is in the inserted position.

3. The lock pin assembly of claim 1, wherein the lock assembly is biased radially inwardly against at least one of the cam and the pin body such that a distal face of the lock assembly is positioned against at least one of a cam outer profile and a pin body outer profile.

4. The lock pin assembly of claim 3, wherein the lock assembly includes:

a base plate threadably received by the second bore;

a follower; and a resilient member, wherein the resilient member extends between the base plate and the follower, and wherein the follower is biased radially inwardly against the cam by the resilient member.

5. The lock pin assembly of claim 1, wherein the first bore extends longitudinally along a longitudinal axis of the main body, and wherein the second bore extends transverse to the longitudinal axis.

6. The lock pin assembly of claim 1, wherein the pin body includes a lock assembly recess shaped and sized complementary to at least a portion of the lock assembly such that the lock assembly recess receives at least a portion of the lock assembly when the pin assembly is in the inserted position and the rotatable shaft is in the locked position.

7. The lock pin assembly of claim 1, wherein the pin body includes:

a trailing portion configured to engage an implement;

a leading portion configured to interface with the lock assembly; and a central portion extending between the trailing portion and the leading portion and including a plurality of pin assembly threads complementary to a plurality of main body threads extending along an inner surface of the first bore.

8. The lock pin assembly of claim 7, wherein the leading portion is tapered.

9. The lock pin assembly of claim 1, further comprising a limit pin extending from a cam inner face, wherein the pin body inner face includes a limit pin race, wherein the limit pin race is configured to receive the limit pin, and wherein the limit pin race is sized and positioned to constrain rotation of the cam to rotation between the locked position and the unlocked position.

10. The lock pin assembly of claim 9, wherein the limit pin is configured to translate rotational energy from rotatable shaft to the pin body.

11. The lock pin assembly of claim 1, further comprising a limit pin extending from the pin body inner face, wherein the cam includes a limit pin race, wherein the limit pin race is configured to receive the limit pin, and wherein the limit pin race is sized and positioned to constrain rotation of the cam to rotation between the locked position and the unlocked position.

12. The lock pin assembly of claim 1, further comprising a second pin assembly and a second lock assembly, wherein the main body includes a third bore extending longitudinally inwardly from an outer face of the main body opposite the first bore, wherein the main body includes a fourth bore extending transverse to the third bore radially inwardly to an intersection with the third bore, wherein the third bore is configured to threadably receive the second pin assembly, and wherein the fourth bore is configured to receive the second lock assembly.

13. A lock pin assembly for securing a wear member including an opening to a support structure having a passage alignable with the opening, the lock pin assembly comprising:

a main body including:

a first bore extending longitudinally inwardly from a main body outer face;

a second bore extending radially inwardly to an intersection with the first bore; and a pin assembly threadably disposable in the first bore to an inserted position, the pin assembly including:

a pin body having a pin body outer face and a pin body inner face;

a rotatable shaft extending longitudinally from the pin body outer face to the pin body inner face, wherein the rotatable shaft is rotatable between a locked position and an unlocked position;

a cam rotationally coupled to the rotatable shaft adjacent the pin body inner face; and a lock assembly disposed in the second bore, wherein the lock assembly is radially displaceable in the second bore and biased radially inwardly to inhibit removal of the pin assembly from the main body when the pin assembly is at the inserted position and the rotatable shaft is at the locked position.

14. The lock pin assembly of claim 13, wherein the pin body extends beyond the main body by a first longitudinal distance to inhibit removal of the wear member from around the support structure when the pin assembly is in the inserted position.

15. The lock pin assembly of claim 13, wherein the lock assembly is biased radially inwardly against at least one of the cam and the pin body such that a distal face of the lock assembly is positioned against at least one of a cam outer profile and a pin body outer profile.

16. The lock pin assembly of claim 13, wherein the lock assembly includes:

a base plate threadably received by the second bore;

a follower; and a resilient member, wherein the resilient member extends between the base plate and the follower, and wherein the follower is biased radially inwardly against the cam by the resilient member.

17. The lock pin assembly of claim 13, wherein the first bore extends longitudinally along a longitudinal axis of the main body, and wherein the second bore extends transverse to the longitudinal axis.

18. The lock pin assembly of claim 13, wherein the pin body includes a lock assembly recess shaped and sized complementary to at least a portion of the lock assembly such that the lock assembly recess receives at least a portion of the lock assembly when the pin assembly is in the inserted position and the rotatable shaft is in the locked position.

19. The lock pin assembly of claim 13, wherein the pin body includes:

a trailing portion configured to engage an implement;

a leading portion configured to interface with the lock assembly; and a central portion extending from the trailing portion and including a plurality of pin assembly threads complementary to a plurality of main body threads extending along an inner surface of the first bore.

20. The lock pin assembly of claim 19, wherein the leading portion is tapered.

21. The lock pin assembly of claim 13, further comprising a limit pin extending from one of the pin body inner face or the cam, wherein the other one of the pin body inner face or the cam includes a limit pin race, wherein the limit pin race is configured to receive the limit pin, and wherein the limit pin race is sized and positioned to constrain rotation of the cam to rotation between the locked position and the unlocked position.

22. The lock pin assembly of claim 13, further comprising a second pin assembly and a second lock assembly, wherein the main body includes a third bore extending longitudinally inwardly from an outer face of the main body opposite the first bore, wherein the main body includes a fourth bore extending transverse to the third bore radially inwardly to an intersection with the third bore, wherein the third bore is configured to threadably receive the second pin assembly, and wherein the fourth bore is configured to receive the second lock assembly.

23. A method for securing a wear member to support structure using a lock pin assembly, wherein the wear member includes a first opening alignable with a second opening in the support structure, the method comprising:

positioning the lock pin assembly within the second opening in the support structure, wherein the lock pin assembly includes a main body;

introducing a pin assembly in the first opening of the wear member and threadably disposing the pin assembly in a first bore of the main body to an inserted position, wherein the first bore extends longitudinally inwardly from an outer face of the main body along a longitudinal axis of the main body, and wherein the pin assembly extends into at least a portion of the second opening when the pin assembly is in the inserted position; and rotating a rotatable shaft from an unlocked position to a locked position, wherein the rotatable shaft extends longitudinally through a pin body of the pin assembly from a pin body outer face to a pin body inner face, wherein the rotatable shaft is rotationally coupled to a cam proximal the pin body inner face, and wherein the cam interfaces with a lock assembly extending from a second bore such that when the rotatable shaft is in the locked position the lock assembly inhibits the pin assembly from rotating and moving from the inserted position.

24. The method of claim 23, further comprising:

threadably disposing a second pin assembly in a third bore to an inserted position of the second pin assembly, wherein the third bore extends longitudinally inwardly from a main body outer face opposite the first bore; and rotating a rotatable shaft of the second pin assembly from an unlocked position to a locked position, wherein a cam of the second pin assembly interfaces with a second lock assembly extending from a fourth bore such that when the rotatable shaft of the second pin assembly is in the locked position the second lock assembly inhibits the second pin assembly from rotating and moving from the inserted position of the second pin assembly.

25. A method for removing a wear member from a support structure using a lock pin assembly, wherein the wear member includes a first opening alignable with a second opening in the support structure, the method comprising:

rotating a rotatable shaft of a pin assembly of the lock pin assembly from a locked position to an unlocked position, wherein the rotatable shaft extends longitudinally through a pin body of the pin assembly from a pin body outer face to a pin body inner face, wherein the rotatable shaft is rotationally coupled to a cam proximal the pin body inner face, and wherein the cam interfaces with a lock assembly extending from a second bore such that, when the rotatable shaft is in the locked position and the pin assembly is in an inserted position, the lock assembly inhibits the pin assembly from rotating and moving from the inserted position and, when the rotatable shaft is in the unlocked position, the lock assembly allows the pin assembly to rotate and move from the inserted position;

threadably removing the pin assembly from a first bore of a main body of the lock pin assembly, wherein the first bore extends longitudinally inwardly from an outer face of the main body along a longitudinal axis of the main body, and wherein the pin assembly extends into at least a portion of the second opening when the pin assembly is in the inserted position; and removing the lock pin assembly from the second opening in the support structure.

26. The method of claim 25, further comprising:

rotating a rotatable shaft of a second pin assembly in a third bore from a locked position to an unlocked position, wherein a cam of the second pin assembly interfaces with a second lock assembly extending from a fourth bore such that when the rotatable shaft of the second pin assembly is in the locked position and the second pin assembly is in an inserted position the second lock assembly inhibits the second pin assembly from rotating and moving from the inserted position of the second pin assembly; and threadably removing the second pin assembly from the third bore, wherein the third bore extends longitudinally inwardly from a main body outer face opposite the first bore.

* * * * *